US007488916B2

(12) United States Patent
Muench et al.

(10) Patent No.: US 7,488,916 B2
(45) Date of Patent: Feb. 10, 2009

(54) VACUUM SWITCHGEAR ASSEMBLY, SYSTEM AND METHOD

(75) Inventors: Frank John Muench, Waukesha, WI (US); Michael Patrick Culhane, Delafield, WI (US); Brian Todd Steinbrecher, Brookfield, WI (US); Paul Newcomb Stoving, Oak Creek, WI (US); John Mitchell Makal, Menomonee Falls, WI (US); Paul Michael Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 214 days.

(21) Appl. No.: 11/273,192

(22) Filed: Nov. 14, 2005

(65) Prior Publication Data

US 2007/0108164 A1 May 17, 2007

(51) Int. Cl.
*H01H 33/02* (2006.01)

(52) U.S. Cl. ..... 218/154; 218/120; 218/155

(58) Field of Classification Search ..... 218/120, 218/134, 138, 139, 140, 154, 155
See application file for complete search history.

(56) References Cited

U.S. PATENT DOCUMENTS

| | | | | |
|---|---|---|---|---|
| 3,471,669 | A | 10/1969 | Curtis | |
| 3,740,511 | A * | 6/1973 | Westmoreland | 200/302.1 |
| 4,568,804 | A | 2/1986 | Luehring | |
| 4,871,888 | A | 10/1989 | Bestel | |
| 4,982,059 | A | 1/1991 | Bestel | |
| 5,175,403 | A | 12/1992 | Hamm et al. | |
| 5,667,060 | A | 9/1997 | Luzzi | |
| 5,717,185 | A | 2/1998 | Smith | |
| 5,736,705 | A | 4/1998 | Bestel et al. | |
| 5,747,765 | A | 5/1998 | Bestel et al. | |
| 5,747,766 | A | 5/1998 | Waino et al. | |
| 5,808,258 | A | 9/1998 | Luzzi | |
| 5,864,942 | A | 2/1999 | Luzzi | |
| 5,912,604 | A | 6/1999 | Harvey et al. | |
| 5,917,167 | A | 6/1999 | Bestel | |
| 6,130,394 | A * | 10/2000 | Hogl | 218/138 |
| 6,362,445 | B1 * | 3/2002 | Marchand et al. | 218/155 |
| 2004/0121657 | A1 | 6/2004 | Muench et al. | |
| 2004/0242034 | A1 | 12/2004 | Rinehart et al. | |

FOREIGN PATENT DOCUMENTS

| | | | |
|---|---|---|---|
| DE | 19906972 | A1 | 2/1999 |
| EP | 0782162 | A2 | 7/1997 |
| WO | WO 00/41199 | | 7/2000 |

* cited by examiner

*Primary Examiner*—Elvin G Enad
*Assistant Examiner*—Marina Fishman
(74) *Attorney, Agent, or Firm*—King & Spalding LLP

(57) ABSTRACT

Insulated vacuum switchgear and active switchgear elements therefor are provided with a rigid support structure mechanically isolating a vacuum insulator from axial loads in use without reinforcing or insulating encapsulations. At least one of the elastomeric insulating housing and the support structure directly contacts an outer surface of the insulator. Systems and methods for assembling the switchgear are also provided.

27 Claims, 11 Drawing Sheets

VACUUM SWITCHGEAR ASSEMBLY, SYSTEM AND METHOD

BACKGROUND OF THE INVENTION

This invention relates generally to high voltage switchgear, and more particularly, to vacuum switch or interrupter assemblies for use in such switchgear.

Utility companies typically distribute power to customers using a network of cables, transformers, capacitors, overvoltage and overcurrent protective devices, switching stations and switchgear. Switchgear is high voltage (e.g. 5 kV-38 kV) equipment used to distribute and control power distribution. Padmounted or underground switchgear includes an enclosure or container that houses bushings, insulation, a bus bar system, and a collection of active switching elements. The active switching elements may include internal active components, such as a fuse, a switch, or an interrupter and external points of connection, such as bushings, to establish line and load connections to an electrical distribution system. Distribution cables transmit power at high voltages. These cables are typically coupled to the switchgear through the switchgear bushings cable connectors. The bushings, in turn, couple to, or form an integral part of, the active switching elements inside the switchgear. The active switching elements are coupled together by a bus bar system in the switchgear assembly.

Other types of switchgear besides padmounted or underground switchgear include switchgear that is used on an overhead distribution system or used in a vault below grade or within load-rooms inside buildings. Such types of switchgear share similar structural and operational components to padmounted switchgear, but are mounted slightly differently and may be connected differently with for example, bare wires instead of insulated cables.

Regardless of the type of switchgear, the active switching elements may be used to open and/or close one or more circuit paths through the switchgear automatically, manually, or remotely. One type of active switching element may be a vacuum switch or interrupter having a movable contact that engages or disengages a fixed contact within a vacuum chamber, often formed in a cylindrical tube or bottle. End caps or plates may be attached to the opposite ends of the bottle, and the fixed contact may be maintained in a stationary manner relative to one of the end caps, while the movable contact is slidable positionable with respect to the other end cap between opened and closed positions with respect to the fixed contact within the bottle. The movable contact may be actuated by an operating mechanism to engage or disengage the movable contact to and from the fixed contact within the vacuum chamber in the bottle.

Known vacuum switch or interrupter devices include a rigid reinforcing structure, such as an epoxy or rigid polymeric molding or casting, encapsulating the bottle. The structure is provided to hold and position the vacuum bottle, typically fabricated from ceramic or glass, and the fixed and movable contacts of the bottle with respect to the operating mechanism. In one such device, an elastomeric sleeve surrounds the bottle, and the sleeve is intended to isolate the bottle from the casting and reduce stress on the vacuum bottle as it is encapsulated within the rigid casting and cured at high temperatures.

It has been found, however, that either the bottle or the casting can nonetheless experience breakage due to thermal, mechanical or electrical, stress as the device is used. The materials used to fabricate the casting and the bottle may have different thermal coefficients of expansion, and heat generated by making (closing the contacts), breaking the circuit (opening the contacts), and interrupting fault currents can be significant, which causes the materials to expand rapidly at different rates. Thermal contraction, when cooling after a manufacturing process such as molding, may also cause thermal stress as the materials contract at different rates. Thermal cycling due to seasonal changes from summer to winter or a daily change from day to night may also produce thermal stress, and the cumulative effects of thermal stress may lead to fatigue and premature failure of the device.

Other known vacuum switch or interrupter devices include elastomeric materials for insulation and shielding purposes. For example, a vacuum bottle may be placed within a rigid wound fiberglass tube. The fixed contact may be secured to one end of the tube and the operating mechanism to the other. A secondary elastomeric filler layer fills a space between the bottle and the tube in an attempt to mechanically isolate the bottle from the rigid tube. The tube assembly, including the bottle and the filler layer, may be placed within an elastomeric housing that provides electrical shielding and insulation for the device.

Despite such efforts to isolate the vacuum bottle from mechanical stress, misalignment of the switch or interrupter devices can nonetheless cause the bottle and/or support structure to break due to mechanical forces associated with opening and closing of the contacts in use. If, for example, an actuator shaft of the operating mechanism is misaligned, however slightly, with the axis of the switch or interrupter device, the bottle, and not the supporting structure for the bottle, can become subject to mechanical loads during opening and closing of the contacts. Depending upon the severity and frequency of such loads, the structural integrity of the bottle can be compromised, and perhaps even destroyed. Loading of the bottle due to misalignment of the bottle with respect to the operating shaft may further cause the switch or interrupter to bind, thereby preventing proper opening and closing of the bottle contacts.

Additionally, some known vacuum switch or interrupter devices are susceptible to slight movement of the bottle with respect to the operating mechanism for the bottle, which presents reliability issues in operation, particularly to those using elastomeric housings. If the bottle is not mounted in a manner that assures the fixed contact end of the bottle is secure and cannot move with respect to the shaft of the operating mechanism, the operating mechanism may not fully open and separate the movable contact from the fixed contact. Alternatively, relative movement between the bottle and the operating mechanism may prevent the operating mechanism from fully closing and engaging the movable contact of the vacuum bottle with respect to the fixed contact. The switch contacts must be fully opened or closed for proper functioning. Further, the switch contacts must be held closed with considerable force applied to the movable contact to hold the movable contact tightly against the fixed contact. If this condition is not met, undesirable arcing conditions may occur between the fixed and movable contacts or the fixed and movable contacts may weld together. Additionally, looseness or play in the mounting of the bottle may contribute to bounce between the contacts as they are closed, and this is detrimental to both the mechanical and electrical interface between the contacts. Bounce can also be a source of stress that weakens the bottle, and may cause the switch contacts to weld together.

In a solid dielectric insulated vacuum switch or interrupter device, insulating layers keep internal conductive elements of the device, which may be energized at either high voltage or electrically grounded, electrically isolated from each other. Furthermore, an external ground shield is sometimes, but not necessarily, provided to maintain outer surfaces of the device at ground potential for safety reasons. This ground shield must also be electrically isolated from the energized components. Electrical isolation between potentials is necessary to prevent faults in the electrical system. There are applications, chiefly on an overhead system where the ground shield may not be required because a physical separation of energized components and ground may provide sufficient electrical isolation. In either case, power interruption to line-side connections of the electrical system fed by the device is prevented. Damage to the device itself or to surrounding equipment is also prevented, and people in the vicinity of the switchgear, including but not limited to maintenance workers and technicians, are protected from hazardous conditions. Providing such insulation in a cost effective manner so as to allow the device to withstand the applied voltage and to isolate the circuit when the switch contacts are in the open position is a challenge.

If the air present within the structure is sufficiently stressed, it may breakdown, resulting in a measurable partial discharge. This breakdown may attack the surrounding insulation, ultimately resulting in failure of the insulation system. Therefore, in addition to the external shields, internal cavities in devices with either an external shield or with internal conductive elements at differing electrical potentials that are in close proximity to each other may be surrounded by rubber shields. Theses shields ensure that any air present within the cavity does not have a voltage gradient across it. Eliminating the possible voltage differential eliminates the electrical stress across the air in the cavity, thereby preventing partial discharge and the resulting insulation degradation.

It is desirable to provide a mounting structure and insulation for vacuum switch or interrupter devices that more capably withstands thermal stress and cycling in use, improves reliability of the switchgear as the contacts are opened and closed, simplifies manufacture and assembly of the devices and associated switchgear, and provides cost advantages in relation to known switch or interrupter devices and associated switchgear.

DETAILED DESCRIPTION OF THE INVENTION

Figure 1:
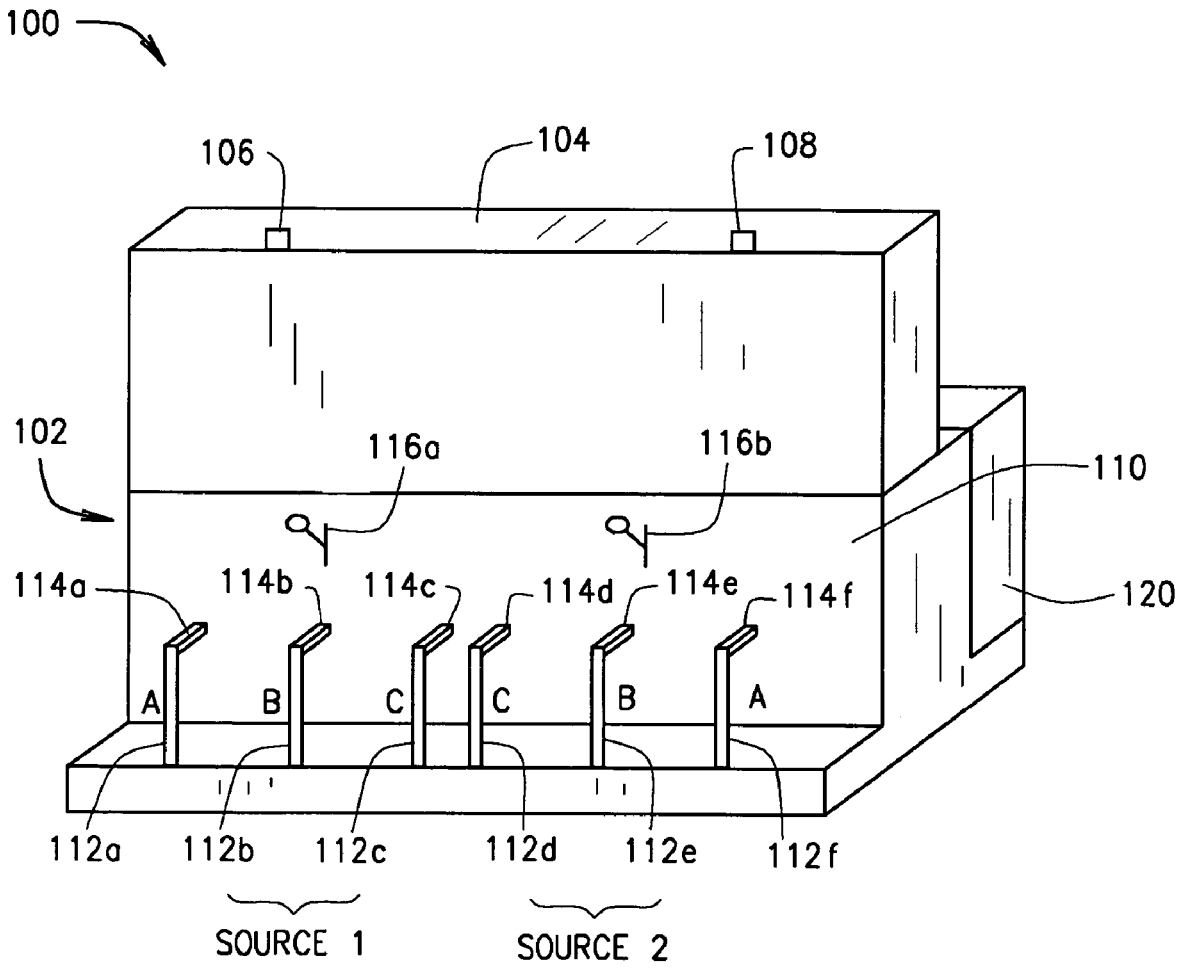
FIG. 1 is a perspective view of electrical switchgear in accordance with an exemplary embodiment of the present invention viewed from a source side of the switchgear.

FIG. 1 illustrates an exemplary switchgear configuration 100 in which vacuum switch or interrupter assemblies according to the present invention may be used. While one exemplary switchgear 100 is described, it is understood that the benefits of the invention accrue generally to switchgear of many configurations, and that the switchgear 100 is but one potential application of the switch or interrupter assemblies described hereinbelow. Switchgear 100 is therefore illustrated and described herein for illustrative purposes only, and the invention is not intended to be limited to any particular type of switchgear configuration, such as the switchgear 100.

Figure 2:
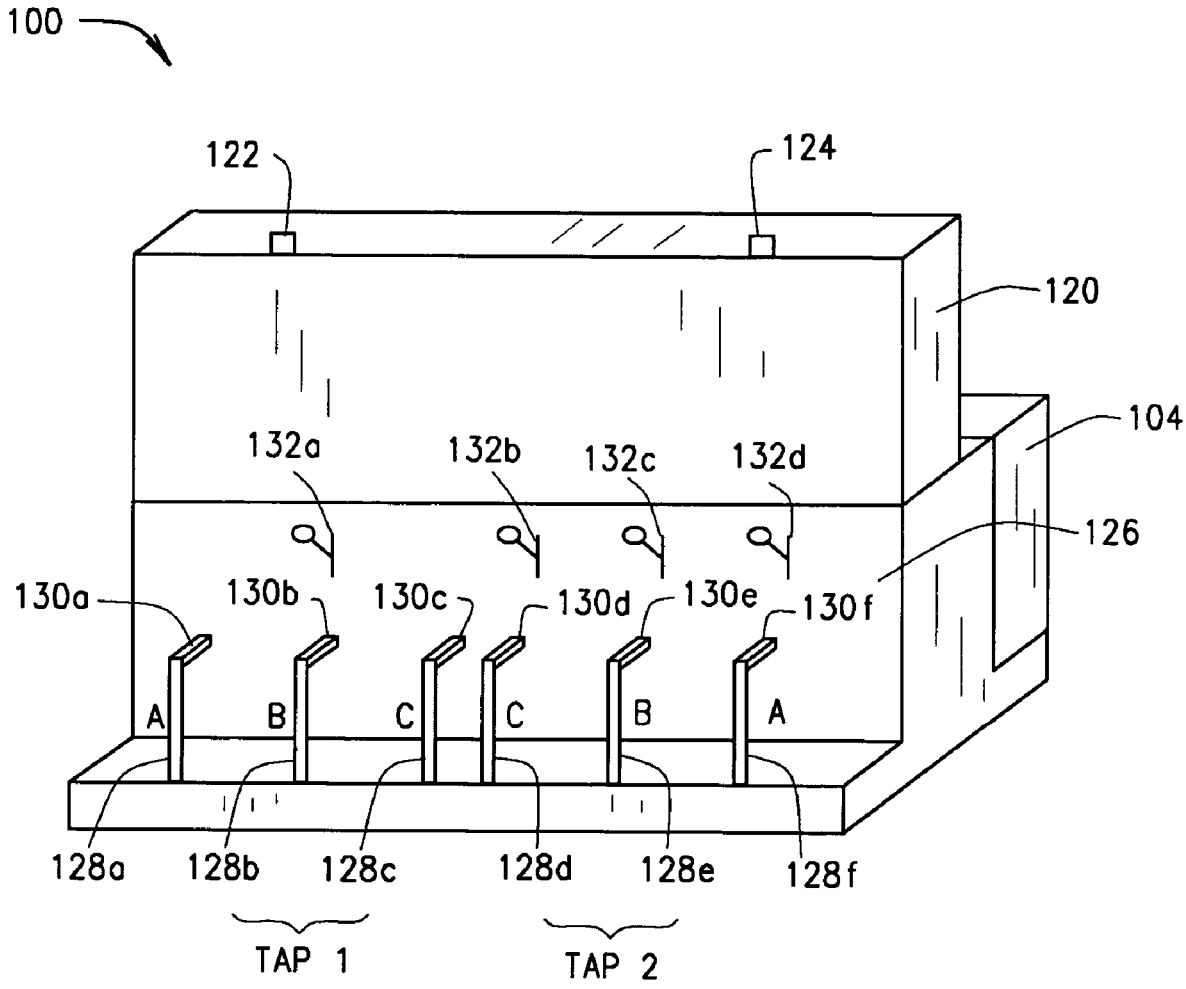
FIG. 2 is another perspective view of the switchgear shown in FIG. 1 viewed from a tap side of the switchgear.

As shown in FIG. 1, the switchgear 100 includes a protective enclosure 102 having, for example, a source side door 104 positionable between an open position (FIG. 1) and a closed position (FIG. 2). Latch elements 106 and/or 108 may be used to lock source side door 104 in a closed position. Inside the source side door 104 is a front plate 110 that forms a portion of the enclosure 102. Cables 112*a*-112*f* may be coupled to a lower end of the enclosure 102 and are connected to active switching elements (described below) in the enclosure 102, and each of the cables 112*a*-112*f* typically carry power in three phases from two different sources. For example, cables 112*a*-112*c* may carry, respectively, the A, B and C phases of power from source 1, and cables 112*d*-112*f* may carry, respectively, the C, B and A phases of power from source 2.

Cables 112*a*-112*f* may be coupled to the front-plate 110 and switchgear 100 through, for example, connector components 114*a*-114*f* that join the cables 112*a*-112*f* to respective switching elements (not shown in FIG. 1) in the enclosure 102. The switching elements may, in turn, be coupled to an internal bus bar system (not shown in FIG. 1) in the enclosure 102.

Handles or levers 116*a* and 116*b* are coupled to the enclosure 102 and may operate active switchgear elements (described below) inside the switchgear 100 to open or interrupt the flow of current through the switchgear 100 via the cables 112*a*-112*f* and electrically isolate power sources 1 and 2 from load-side or power receiving devices. The cables 112*a*-112*c* may be disconnected from the internal bus bar system by manipulating the handle 116*a*. Similarly, cables 112*d*-112*f* may be disconnected from the internal bus bar system by manipulating the handle 116*b*. Handles 116*a* and 116*b* are mounted onto the front-plate 110 as shown in FIG. 1. In an exemplary embodiment, the active switch elements on the source side of the switchgear 100 are vacuum switch assemblies (described below), and the vacuum switch assemblies may be used in combination with other types of fault interrupters and fuses in various embodiments of the invention.

One exemplary use of switchgear is to segregate a network of power distribution cables into sections such as, for example, by opening or closing the switch elements. The switch elements may be opened or closed, either locally or remotely, and the power supplied from one source to the switchgear may be prevented from being conducted to the other side of the switchgear and/or to the bus. For example, by opening the switch levers 116*a* and 116*b*, power from each of the sources 1 and 2 on one side of the switchgear is prevented from being conducted to the other side of the switchgear and to the bus and the taps. In this manner, a utility company is able to segregate a portion of the network for maintenance, either by choice, through the opening of switchgear, or automatically for safety, through the use of a fuse or fault interrupter, depending on the type of active switching elements included in the switchgear.

FIG. 2 illustrates another side of the switchgear 100 including a tap side door 120 that is positionable between open (shown in FIG. 2) and closed (FIG. 1) positions in an exemplary embodiment. Latch elements 122 and/or 124 may be used to lock the tap side door 120 in the closed position. Inside the tap door 120 is a front-plate 126 that defines a portion of the enclosure 102. Six cables 128*a*-128*f* may be connected to a lower side of the switchgear 100, and each of the respective cables 128*a*-128*f* typically carries, for example, one phase of power away from switchgear 100. For example, cable 128*a* may carry A phase power, cable 128*b* may carry B phase power and cable 128*c* may carry C phase power. Similarly, cable 128*d* may carry C phase power, cable 128*e* may carry B phase power and cable 128*f* may carry A phase power. Connectors 130*a*-130*f* connect cables 128*a*-128*f* to switchgear.

It should be noted that the exemplary switchgear 100 in FIGS. 1 and 2 shows one only one exemplary type of phase configuration, namely an ABC CBA configuration from left to right in FIG. 2 so that the corresponding cables 128*a*-128*c* and 128*d*-128*f* carry the respective phases ABC and CBA in the respective tap 1 and tap 2. It is understood, however, that other phase configurations may be provided in other embodiments, including but not limited AA BB CC so that cables 128*a* and 128*b* each carry A phases of current, cables 128*c* and 128*d* each carry B phases of current, and so that cables 128*e* and 128*f* each carry C phases of current. Still other configurations of switchgear may have one or more sources and taps on the same front-plate 110 (FIG. 1) or 126 (FIG. 2), or on the sides of the switchgear on one or more additional front plates. It also contemplated that each phase may be designated by a number, such as 1, 2 and 3, and that the switchgear may accommodate more or less than three phases of power. Thus, a switchgear may have, for example only, a configuration of 123456 654321 on the tap side of the switchgear 100.

A frame may be positioned internal to the switchgear and provide support for the active switching elements as well as the bus bar system, described below. In other words, the frame holds the active switching elements and bus bar system in place once they are coupled to the frame. The frame is oriented to allow portions of the active switching elements, typically bushings, to protrude as a bushing plane so that connections to the various cables can be made.

In an exemplary embodiment, a lever or handle 132*a* operates active switchgear elements, as described below, inside the switchgear 100 to disconnect cables 128*a*, 128*b*, 128*c* from the internal bus bar system. Similarly, handles 132*b*-132*d* cause one of individual cables 128*d*, 128*e*, 128*f* to disconnect and connect, respectively, from the internal bus bar system. In an exemplary embodiment, the active switchgear elements on the tap side of the switchgear 100 include vacuum interrupter assemblies (described below), and the vacuum interrupter assemblies may be used in combination with fuses and various types of fault interrupters in further and/or alternative embodiments of the invention.

Figure 3:
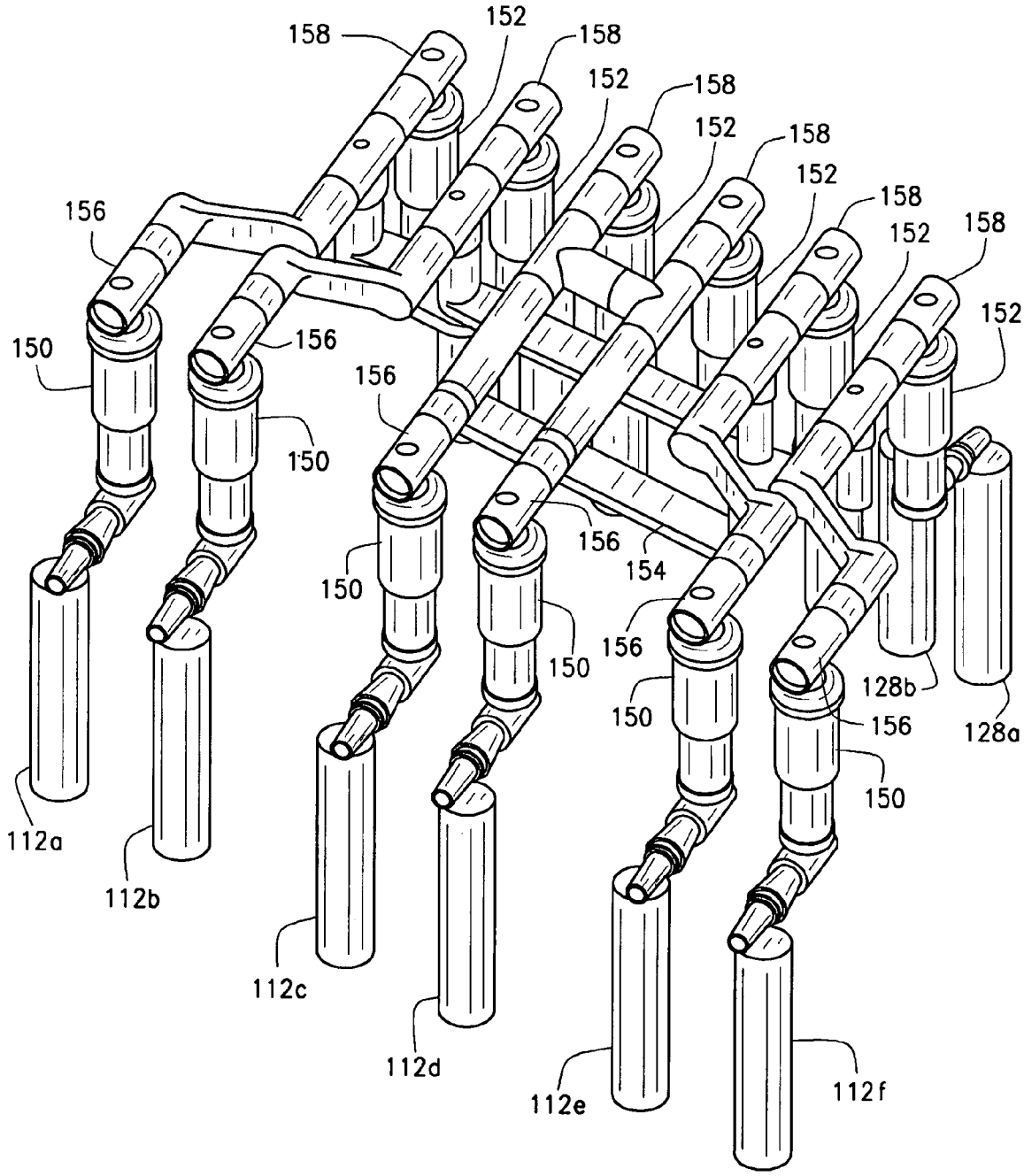
FIG. 3 is a perspective view of internal components of the switchgear shown in FIGS. 1 and 2.

FIG. 3 is a perspective view of exemplary internal components of the switchgear 100 removed from the enclosure 102 and without the supporting frame. Switch element assemblies 150 and fault interrupter assemblies 152 may be positioned on opposites sides (i.e., the source side and the tap side, respectively) of the switchgear assembly. Cables 112*a*-112*f* may be connected to respective switch element assemblies 150, and cables 128*a*-128*f* (cables 128*c*-128*f* not labeled in FIG. 3) may be connected to the respective interrupter element assemblies 152.

A bus bar system 154 may be situated in between and may interconnect the switch element or interrupter assemblies 150 and 152 via connectors 156 and 158. In different embodiments, the bus bar system 154 includes conventional metal bar members formed or bent around one another, or a modular cable bus and connector system. The modular cable bus system may be assembled with mechanical and push-on connections into various configurations, orientations of phase planes, and sizes of bus bar systems. In still another embodiment, molded solid dielectric bus bar members may be provided in modular form with push-on mechanical connectors to facilitate various configurations of bus bar systems with a reduced number of component parts. In still other embodiments, other known bus bar systems may be employed as those in the art will appreciate.

Figure 4:
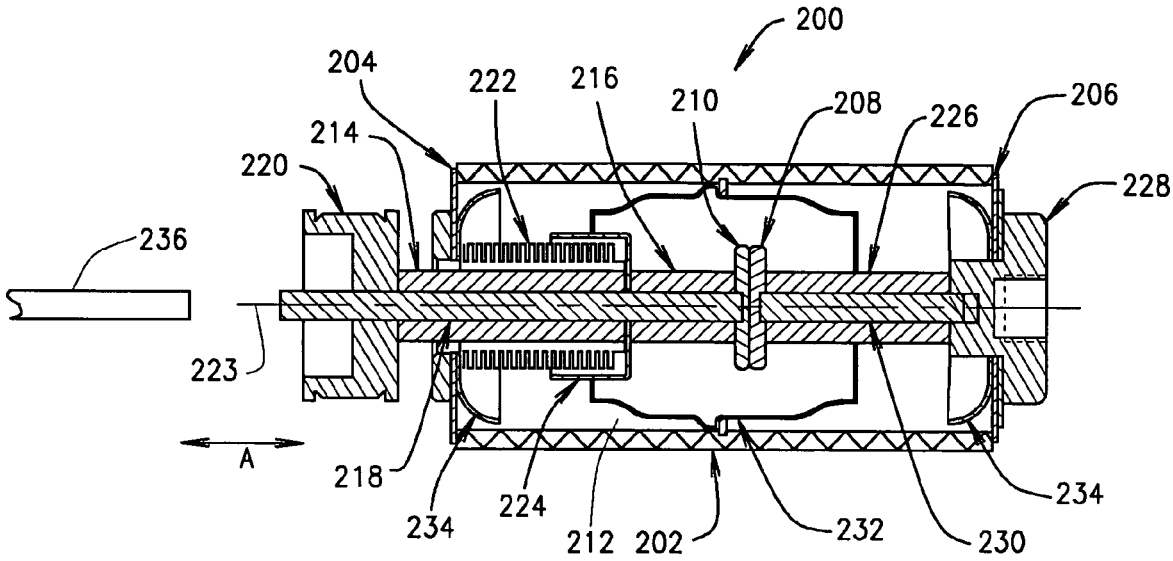
FIG. 4 is a cross sectional view of an exemplary vacuum bottle assembly which may be used with the present invention.

FIG. 4 is a cross sectional view of an exemplary vacuum bottle assembly 200 which may be used in one or more of the active switch element or interrupter assemblies 150, 152 in the switchgear 100 (shown in FIGS. 1-3).

The bottle assembly 200 includes an insulator 202, end plates 204 and 206 coupled to either end of the insulator 202, a fixed contact 208 mounted in a stationary manner to the end plate 206, and a movable contact 210 that is selectively positionable relative to each of the end plates 204 and 206 and the fixed contact 208 to complete or break a conductive path through the bottle assembly 200. Depending upon the position of the movable contact 210 relative to the fixed contact 208, the bottle assembly 200 may be used to conduct electrical current through the assembly, or, in the alternative, to open or interrupt the current path through the assembly 200.

The insulator 202 may be fabricated from a substantially non-conductive or insulating material such as glass, ceramic or other suitable material known in the art into a cylindrical or tubular shape or form having a central opening or bore 212 extending between the opposite ends of the bottle wherein the end caps 204, 206 are attached in a known manner. In different embodiments, the insulator 202 may be fabricated integrally in a one-piece construction, or alternatively may be fabricated from multiple pieces joined together to form a unitary construction. The insulator 202 positions and locates the other components of the assembly 200 and provides electrical insulation when the contacts 208, 210 are separated.

An external conducting rod 214 defines a conductive path through the end cap 204 to the interior bore 212 of the bottle assembly 200. A second, internal, conducting rod 216 is coupled to the rod 214 and defines a conductive path to the movable contact 210 which is mounted thereto. A reinforcing rod 218, fabricated from stainless steel in one embodiment, provides mechanical strength to the combination of the rods 214 and 216. In an alternative embodiment the external and internal conducting rods 214 and 216 may be replaced with a single conductive rod.

A piston-shaped current exchange 220 is mounted to an exterior end of the conducting rod 214 protruding from the bottle through the end plate 204. The current exchange 220 is configured for electrical connection to an external current exchange (described below) that may be connected to a power cable, such as one of the cables 112*a*-112*f* and 128*a*-128*f* shown in FIGS. 1 and 2. In alternative embodiments, electrical connection to an external current exchange and/or power supply cables may be provided via conductive braids, flexible leads, or other known connection schemes in lieu of the current exchange 220.

A flexible metallic bellows 222 is situated in the bore 212 of the bottle assembly 200 and the bellows 222 extends between the end plate 204 and common ends of conducting rods 214 and 216. The bellows 222 surrounds the rod 214 within the bore 212 of the bottle assembly 200. The flexible bellows 222 allows the rods 214, 216 and the movable contact 210 to move along an axis 223 of the bottle assembly 200 in the directions of arrow A while maintaining a vacuum seal within the bottle assembly 200.

A shield 224 partly surrounds and protects the bellows 222 from damaging metallic splatter and vapor that may be generated during a high-current interruption when the movable contact 210 is separated from the fixed contact 208.

The stationary contact 208 is coupled to an internal rod 226, and the internal rod 226 is, in turn, coupled to an external contact 228 to provide an external electrical conductive path and connection to the stationary end of the bottle assembly 200. The external contact 228 also rigidly connects with the end plate 206. A stainless steel reinforcing rod 230 may be provided to strengthen the conductive rod structure at the stationary end of the bottle assembly 200.

An internal shield 232 partly surrounds the contacts 208 and 210 in the bore 212 of the bottle assembly 200, and along with end shields 234, the shield 232 provides for proper screening and control of the electric field within the bottle assembly 200. These shields 232, 234 define a location where any by-products that may result from electrical arcing when the movable contact 210 is separated from the stationary contact 208 to condense, thereby protecting the insulation integrity of the insulator 202.

Once the components are assembled, the bottle assembly 200 is placed into a large vacuum chamber, where gases are removed from the bottle assembly 200. Brazing materials are placed between the components at appropriate places to ensure electrical connection and airtight sealing between component parts, and while the assembly 200 is within the vacuum chamber, the assembly 200 is heated to a temperature wherein the brazing materials melt and reflow. When the assembly 200 returns to room temperature, a hard vacuum is created within the vacuum bottle assembly 200. A hard vacuum has a very high dielectric strength that quickly recovers should an arc result when the movable contact 210 is separated from the fixed contact 208. Additionally, because no oxidation of the contacts 208, 210 can occur within the vacuum, the assembly 200 is a very effective way to carry current in a switch or interrupter element assembly, such as the switch or interrupter element assemblies 150 and 152 shown in FIG. 3. The assembly 200 also provides for effective interruption of current at high voltage. For example, current can be effectively interrupted at voltages of about 38 kV with as little as 0.5 inches or less of movement of the movable contact 210 relative to the fixed contact 208 along the axis 223.

An actuator element, such as an actuator shaft 236 is driven by an actuating mechanism known in the art to move the movable contact 210, via the rod 218, in the directions of arrow A between opened and closed positions. In the opened position, the movable contact 210 is moved away from the fixed contact 208 (to the left in FIG. 4) to separate the contacts. In the closed position (shown in FIG. 4), the movable contact 210 is pressed against the fixed contact 208 to complete a conductive path through the contacts. On interrupter versions of the device a sensor and trigger system (not shown) may be used to sense the presence of a fault current flowing into the bottle assembly 200. After the fault is sensed, the trigger system causes movement of the shaft 236 to separate the contacts 210, 208 and interrupt the conductive path therebetween, thereby opening the circuit through the bottle assembly 200.

Holding and supporting the bottle assembly 200 is important so that sufficient force is applied through the movable contact 210 to allow efficient current interchange between the fixed and movable contacts 208, 210 when the contacts are closed. Any "softness" or play in the mounting of the bottle assembly 200 can cause a decrease in contact force when the contacts are closed, which can result in the contacts 210, 208 welding together or bursting open. The vacuum insulator 202, as well as its braze joints to the end caps 204, 206, is relatively strong but can be broken if excessive force is placed on it during operation of the assembly 200. Such force may result from misalignment of the bottle assembly 200 with respect to the operating mechanism that moves the movable contact 210 such as, for example, when the force that moves the movable contact 210 is not in line with the axis 223 of the bottle assembly 200. Force on the bottle may also result from differential expansion rates experienced by the insulator 202 and the structures that hold and support it while current is being carried or interrupted, or simply from the mounting structure that holds the bottle in place.

As will now be explained in detail, the present invention provides supporting structures for mounting the bottle assembly 200 in a manner that avoids the above-mentioned mounting issues. Additionally, the present invention provides adequate shielding and insulation of the bottle assembly 200 and supporting structures to be sure that the applied voltage such as, for example, 1 to 38 kV, does not cause a breakdown in or near the assembly 200. Additionally, a high voltage AC withstand may be up to 70 kV rms, and impulse voltages may be up to 150 kV peak, and the shielding and insulation of the bottle assembly 200 ensure that these voltages do not cause a breakdown in or near the assembly 200. If a breakdown were to occur, a fault would occur on the larger electrical system, potentially damaging other equipment, while preventing power from reaching customers connected to the switchgear 100 through the bottle assembly 200.

Figure 5:
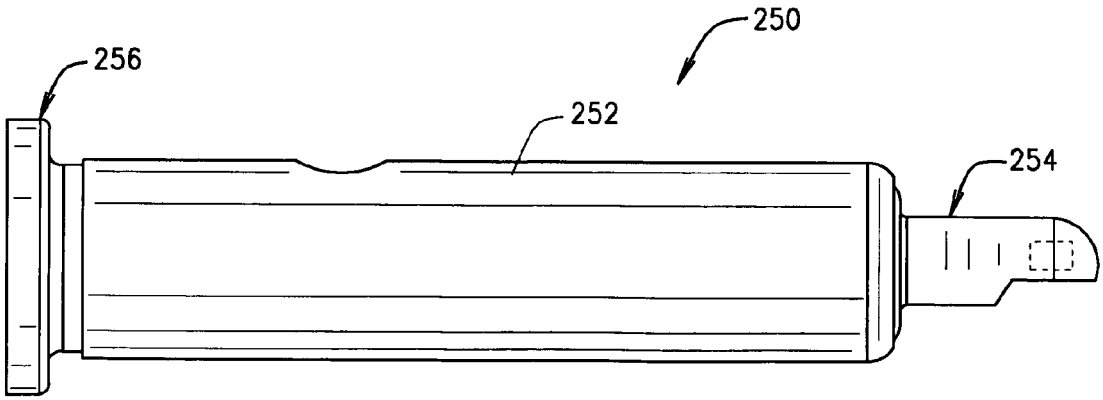
FIG. 5 is a side view of a switch or interrupter module according to one embodiment of the present invention.

FIG. 5 is a side view of an exemplary switch or interrupter module 250 according to one embodiment of the present invention. The switch or interrupter module 250 may be used in, for example, the active switching or interrupting element assemblies 150 and 152 (shown in FIG. 3) in the switchgear 100 (FIGS. 1 and 2), although it is recognized that the switch or interrupter module 250 may be used in other types of switchgear and other types of equipment as desired. The switch or interrupter module 250 may further be used in subsurface, overhead or above ground installations, or even submerged or underwater installations in a power distribution system.

The module 250 includes a mounting structure 252 that receives, protects, and supports the bottle assembly 200 (FIG. 4). A stationary contact 254 extends outwardly from one end of the support structure 252 and is rigidly connected to the stationary end of the bottle assembly 200 and an actuator throat connector 256 extends outwardly from the opposite end of the support structure 252. The throat connector 256 engages and connects to, for example, the operating mechanism that operates the actuator shaft 236 (FIG. 4) to open and close the conductive path through the bottle assembly 200 by moving the movable contact 210 relative to the fixed contact 208 (FIG. 4).

Figure 6:
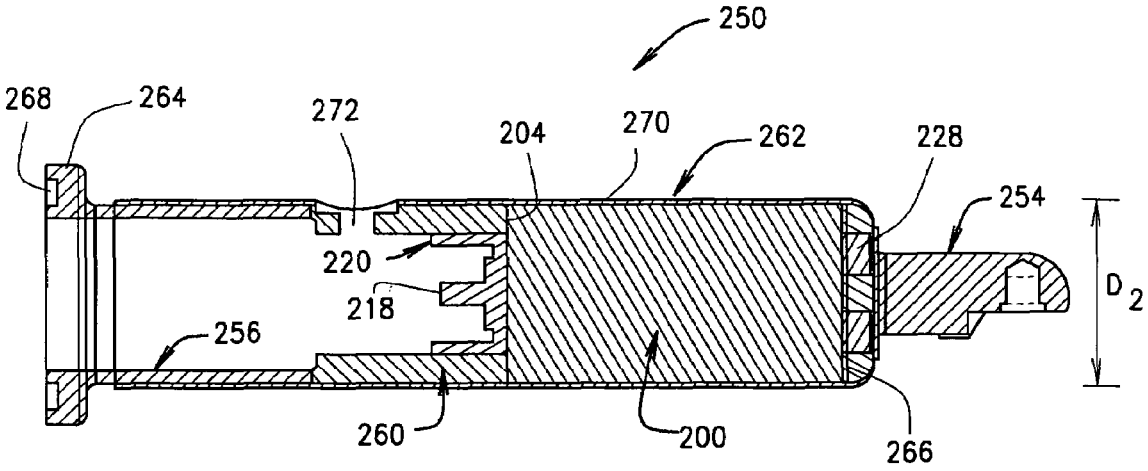
FIG. 6 is a cross sectional view of the switch or interrupter module shown in FIG. 5.

FIG. 6 is a cross sectional view of the switch or interrupter module 250 including the bottle assembly 200, an external current exchange 260 adjacent to the bottle end plate 204 (FIG. 4), the throat connector 256, and the stationary contact 254, all of which are secured and maintained in position relative to one another with a composite overwrap layer 262 as explained below.

The external current exchange 260 is cylindrical or tubular in shape in one embodiment, and the external current exchanges surrounds and provides a mechanical and electrical interface with the current exchange 220 of the bottle assembly 200. A portion of the reinforcing rod 218 (also shown in FIG. 4) of the bottle assembly 200 extends axially from the bottle end plate 204 and is surrounded by the internal current exchange 220. The reinforcing rod 218 of the bottle assembly 200 includes, for example, threads or other features to attach and engage the actuator shaft 236 (FIG. 4) of the operating mechanism. The throat connector 256 is aligned with and is adjacent to an end of the external current exchange 260.

An end 264 of the throat connector 256 is formed into a rim or flange that mates with the operating mechanism (not shown) so that the fixed contact end or stationary end 266 of the bottle assembly 200 is held rigidly with respect to the operating mechanism, through the overwrap layer 262. The rigid connection allows the operating shaft 236 (shown in FIG. 4) to provide the proper contact movement and cause the shaft 236 to hold the contacts 210, 208 (FIG. 4) closed with the proper force. The end 264 of the throat connector includes an annular groove 268, and a gasket (not shown in FIG. 6) is seated in the groove 268 between the module assembly 250 and the operating mechanism in an exemplary embodiment.

The contact 254 is attached to the stationary end 266 of the bottle assembly 200, and in an illustrative embodiment the contact 254 includes two parts that are threaded together, although it is appreciated that various types of contacts may be used in single or multiple pieces attached to one another by any of a variety of techniques known in the art. The contact 254 is mechanically and electrically engaged to the external contact 228 of the bottle assembly 200.

When the bottle assembly 200, the external current exchange 260, the throat connector 256, and the contact 254 are aligned and assembled with one another, the assembly of components is placed in a fixture and a solid but flexible composite wrap is applied over substantially the entire outer surface of the components. The composite wrap is applied directly to and is in intimate contact with the outer surface of the bottle and is wrapped about the bottle and the outer surfaces of the other components. The composite material defines a void free contact interface with the bottle outer surface 270 that is substantially, if not completely, devoid of air gaps that could produce an electrical discharge. Once applied to the outer surfaces of the component assembly, the composite wrap is then subjected to chemical, thermal, UV radiation, or other curing process to cause a binding material in the composite wrap material to polymerize and cross-link, creating the rigid, self supporting overwrap layer 262.

Because the composite wrap is applied to the components as a flexible solid material in sheet form, the composite wrap has a definite shape and volume when applied to the components, unlike liquid materials having no definite shaped or volume that are commonly used in casting, molding, coating and other known encapsulant processes wherein the liquid materials are subsequently cured or hardened to a solid form around a bottle assembly. The solid and flexible composite wrap is also unlike known liquid and gas insulation materials and dielectrics having no definite shape and form that are sometimes used to encapsulate or surround the bottle by, for example, immersion of the bottle in such materials. By avoiding such liquid or gaseous materials for insulation purposes, the definite volume and shape of the overwrap layer simplifies the manufacture of the bottle assembly 200 and its installation into switchgear.

In one exemplary embodiment, the composite wrap material used to form the overwrap layer 262 includes fiberglass, Kevlar™ or other matting or continuous strands of insulating material embedded in a polymeric compound that becomes rigid when it is fully cured. One such material is commercially available from J.D. Lincoln, Inc. of Costa Mesa, Calif. and is designated as L-201-E, although similar materials from other suppliers may be used. Advantageously, the overwrap layer 262 provides structural strength to resist structural loads as the bottle assembly 200 is actuated to open and close the contacts 210, 208 therein.

Additionally, and unlike known filled epoxy encaspulants for the bottle, the embedded insulating material in the composite material used to form the overwrap layer 262 reduces the coefficient of thermal expansion of the overwrap layer 262 to a value approximately equal to the coefficient of thermal expansion of the embedded insulating material, which is of similar order to or approximately equal to the coefficient of thermal expansion of the ceramic insulator 202, even while the coefficient of thermal expansion of the epoxy or other binding resin employed in the composite material is different from the bottle.

In one exemplary embodiment, the bottle is fabricated from alumina ceramic material having a coefficient of thermal expansion within a range of about 2 to about $20\times10^{-6}$ mm/mm/degrees C., and more specifically in a range of about 5 to about $10\times10^{-6}$ mm/mm/degrees C. over a temperature range of −40° C. to about 160° C. For purposes of comparison, the composite wrap material has, for example, a coefficient of thermal expansion within a range of about 11 to about $50\times10^{-6}$ mm/mm/degrees C. Also for purposes of comparison, a known filled epoxy has a coefficient of thermal expansion within a range of about 25 to $50\times10^{-6}$ mm/m/degrees C. in the temperature range of −40° C. to about 100° C., and a coefficient of thermal expansion within a range of about 80 to $120\times10^{-6}$ mm/mm/degrees C. in the temperature range of 100° C. to about 160° C.

Because the coefficients of expansion are of similar order between the alumina ceramic bottle material and the composite wrap material when cured, thermal stress associated with temperature cycling and heat attributable to current loads and making and breaking of the contacts 210, 208 in the bottle assembly 200 is therefore avoided because that bottle assembly 200 and the overwrap layer 262 expand and contact with temperature at approximately the same rate. The reduction in thermal expansion provided by the continuous reinforcement of the overwrap layer 262 keeps thermal stress from exceeding the strength of the materials, preventing breakage during operation.

In addition to forming a continuous reinforced structure, the overwrap layer 262 has sufficient polymeric material to act as an adhesive during installation of the composite material, so the module assembly 250 forms a structurally sound module. This bonding of the bottle assembly 200 and the composite wrap allows the module assembly 250 to withstand the continual voltage stress placed on it in use.

As the composite wrap 262 and the bottle assembly 200 have similar thermal coefficients of expansion, thermal stresses are alleviated and the need for a buffer material such as a separate rubber sleeve surrounding the bottle assembly 200, as is used is some conventional types of switchgear, may be eliminated. Thus, the module assembly 250 uses fewer parts, eliminates manufacturing steps, and is less costly than conventional epoxy encapsulated vacuum switchgear.

After the overwrap layer 262 is fully cured, the wrap layer 262 is cut away in the region of a threaded cross-hole 272 in the external current exchange 260. The cross hole 272 accepts a contact for connection to a power cable when the module assembly 250 is assembled into an active switchgear element assembly, such as the switch or interrupter element assemblies 150 and 152 (FIG. 3), as explained below.

Figure 7:
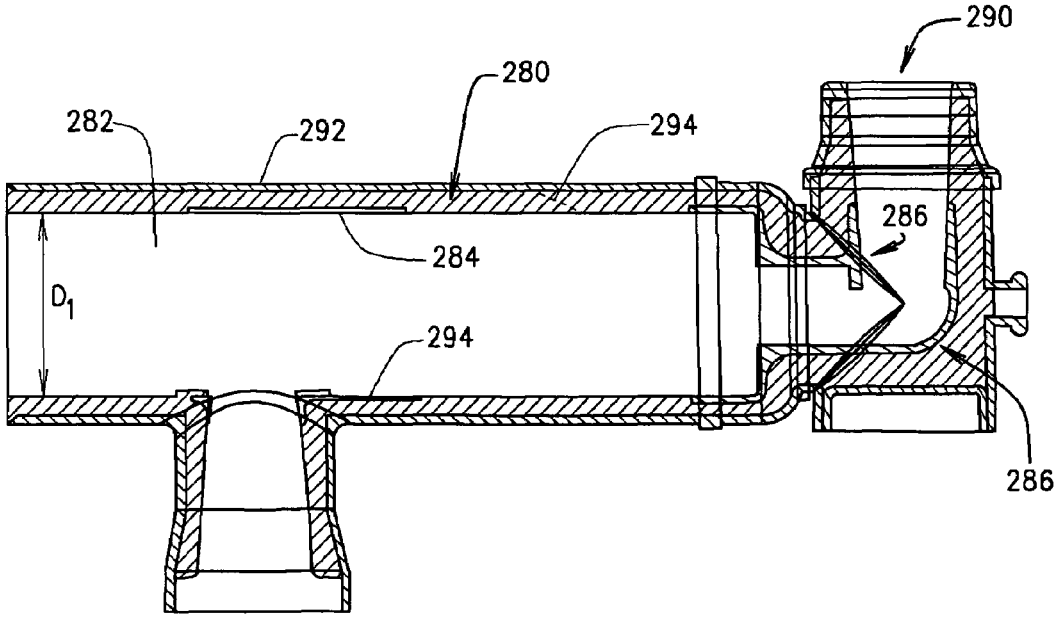
FIG. 7 is a cross sectional view of an insulating housing which may be used with the switch or interrupter module shown in FIGS. 5 and 6.

FIG. 7 is a cross sectional view of an exemplary insulating housing 280 which may be used with the switch or interrupter module 250 (shown in FIG. 6).

In an exemplary embodiment, the insulating housing 280 is fabricated from an elastomeric material having a low modulus and high elongation to define a flexible or resilient structure according to a known process. In one embodiment, the housing may be fabricated from molded rubber into a generally cylindrical or tubular body having a central bore 282 dimensioned to accommodate the module assembly 250 (FIGS. 5 and 6) therein. Internal stress relief inserts 284, 286 are fabricated from conductive rubber and are applied to designated portions of the inner surface of the housing 280 to maintain a uniform voltage within the volume they enclose. The inserts 284, 286 prevent discharges from occurring inside the regions they enclose. Mating interfaces 288, 290, sometimes referred to as bushings, are molded into and extend from the housing 280, and the interfaces 288 and 290 accept mating parts that enable the module 250 to be connected to an electrical system via, for example, the switchgear 100 (shown in FIGS. 1-3).

An outer conductive ground shield 292 surrounds substantially the entire exterior surface of the housing 280 in an exemplary embodiment, and for safety reasons the ground shield 292 is maintained at ground potential when the module 250 is energized.

An inner diameter $D_1$ of the rubber housing 280 is slightly smaller than the outer diameter $D_2$ of the module 250 (FIG. 6). When the module 250 is inserted into the housing 280, the resulting interference between the outer surface of the module 250 and the inner surface of the housing 280 allows the entire assembly to withstand the applied voltage when the contacts 210, 208 of the bottle assembly 200 (FIG. 4) are open or closed. The intimate fit between the interfering surfaces of the module assembly 250 and the housing 280 also forces air from the interface between the two surfaces, thereby preventing air gaps and associated electrical discharges that could cause electrical failures.

In one embodiment, the housing 280 may be formed in a single piece, monolithic construction. In another embodiment, the housing may be formed of two or more pieces joined at a tapered, overlapping seam 294 (shown in phantom in FIG. 7) to ensure adequate dielectric strength.

Figure 8:
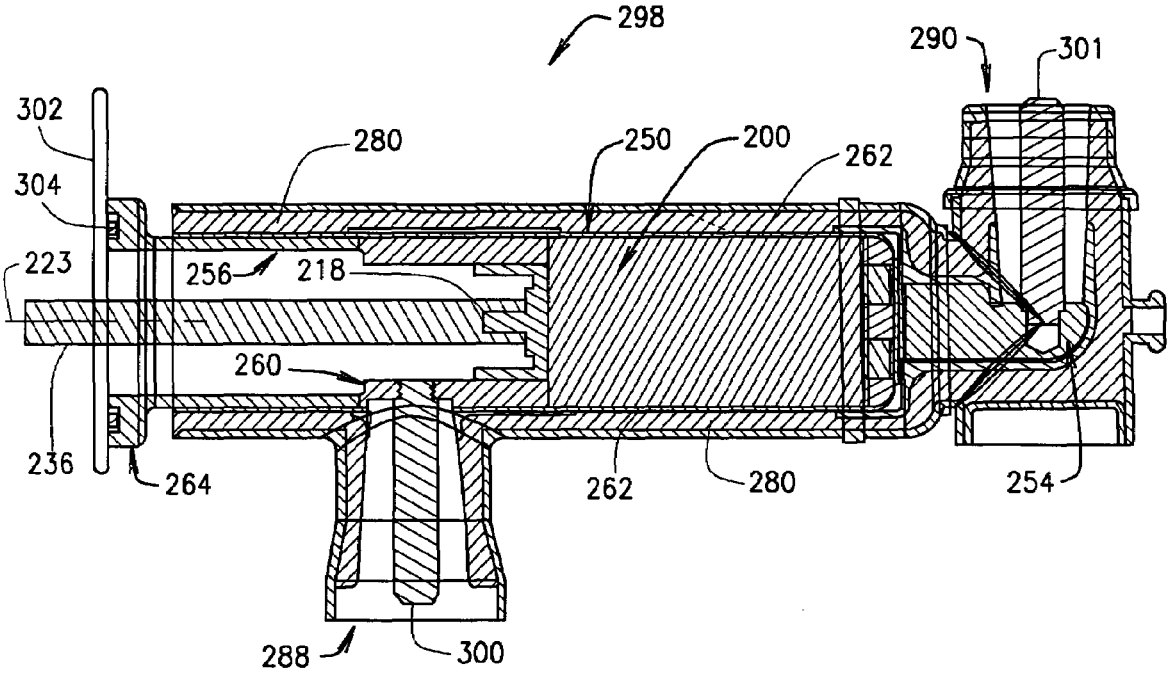
FIG. 8 is a cross sectional view of a switch or interrupter assembly including the housing shown in FIG. 7 and the switch or interrupter module shown in FIG. 5.

FIG. 8 is a cross sectional view of an exemplary switch or interrupter assembly 298 including the housing 280 with the switch or interrupter module 250 inserted therein. The composite overwrap layer 262 is sandwiched between the housing 280 and the bottle assembly 200. The overwrap layer 262 directly contacts the outer surface of the bottle without the presence of any intervening layers or materials, and also directly contacts the inner surface of the insulating housing 280.

Various fixtures and guides are used to ensure the threaded hole 272 (FIG. 6) in the module 250 and the location of the interface 288 of the housing 280 correspond in location, and further so that the contact 254 and the location of the interface 290 of the housing 280 correspond in location. A module contact 300 is attached to the module 250 through the threaded hole 272 and engages the external current exchange 260 of the module 250. In the illustrated embodiment, this connection is threaded but this function may be accomplished by other techniques in other embodiments. A module contact 301 is received in the interface 290 and is threaded to the contact 254, although other non-threaded attachment schemes could likewise be employed in other embodiments.

The operating shaft 236 is attached by threading it to the movable contact 210 (FIG. 4) via the rod 218 in the illustrated embodiment, although it is contemplated that non-threaded attachments or connections may be established in alternative embodiments. The operating mechanism, represented by a stationary plate 302 thereof, is joined with the end 264 of the throat connector 256, and a gasket 304 seals the entry between the throat connector 264 and the operating mechanism. Mating connectors, sometimes referred to as bushings or elbows mate with the interfaces 288, 290 and the respective contacts 300, 301 to connect the assembly 298 to power cables and the bus bar as described above with respect to FIGS. 1-3.

As shown in FIG. 8, the overall switch or interrupter assembly 298 is constructed in a "Z" shape or configuration in an exemplary embodiment. In another embodiment, the end bushing/elbow interfaces 288, 290 may alternatively be formed in a "C" shape or configuration in the overall assembly 298, or still alternatively with a "V" or "T" shape or configuration at either end or with connections in line with the axis 223 of the assembly 298. A two-piece rubber housing 280 is effective at allowing the alternate shapes to be created and used. The alternate shapes may be used to help the user of the module connect the module 250 to the electrical system in varying ways to make the module easier and safer to install and operate.

Once connected to the operating mechanism plate 302, which is securely mounted in a stationary manner, the overwrap layer 262 provides a rigid mechanical connection to the plate 302 at one end and the stationary end 228 of the bottle assembly 200 at the other end. Thus, once assembled to the operating mechanism, the bottle assembly 200 is assured to remain aligned with the operating shaft 236 to avoid structural loading of the bottle assembly to which known vacuum switch or interrupter devices are susceptible. Additionally, any axial or non-axial loading that may occur due to normal or abnormal operation of the actuator shaft 236 is borne by the overwrap layer 262 and not the bottle assembly 200 (or the insulator 202) due to the direct contact of the overwrap layer 262 and the bottle outer surface. The rigid continuous reinforcement of the overwrap layer forms a self supporting and structurally adequate assembly 298 to withstand operating forces and applied loads in use more capably, and because the overwrap layer 262 expands and contract at roughly the same rate as the bottle assembly 200, thermal stresses are substantially reduced in the overall assembly 298.

Figure 9:
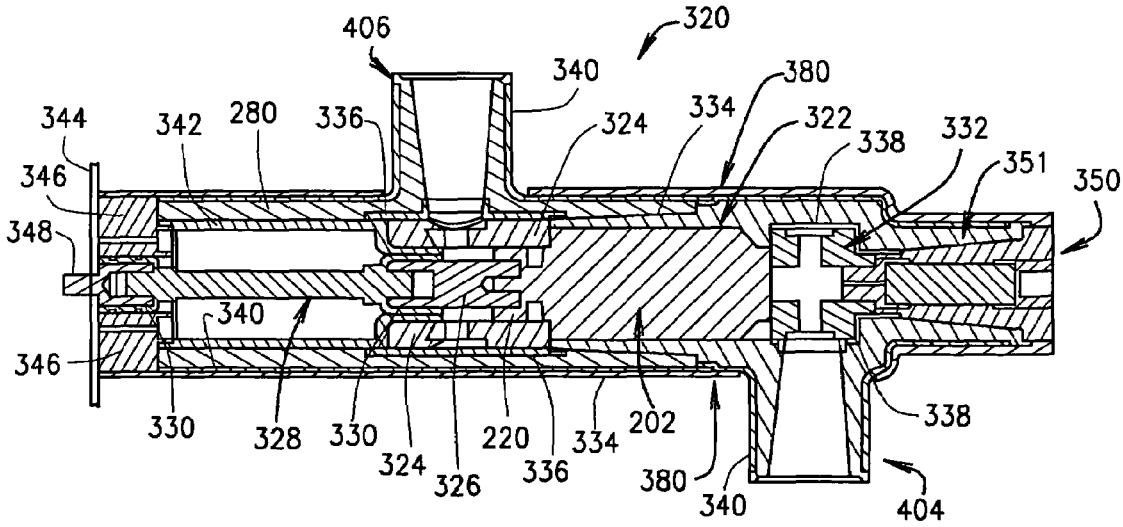
FIG. 9 is a cross sectional view of another switch or interrupter assembly according to the present invention.

FIG. 9 is a cross sectional view of another exemplary switch or interrupter assembly 320 according to the present invention. In some aspects, the assembly 320 is similar to the assembly 298 (FIG. 8) described above, and like reference characters are therefore used to indicate corresponding features common to the assembly 320 and the assembly 298.

Unlike the assembly 298 having an internal support structure of the overwrap layer 262 described above for the bottle assembly, the switch assembly 320 has an external support structure for the bottle assembly, as explained below.

As shown in FIG. 9, the switch or interrupter assembly 320 includes the insulating housing 280 receiving and enclosing a vacuum switch or interrupter 322. The switch or interrupter 322 includes the bottle assembly 200, the internal current exchange 220 defining a current path to the movable contact 210 (FIG. 4) in the bottle assembly 200, an external current exchange 324, a coupler 326, an actuating shaft 328, shaft guides 330 extending from the shaft 328, and an external bottle contact 332 rigidly connected to the fixed contact 208 (FIG. 4) within the bottle assembly 200.

In an exemplary embodiment, the housing 280 is fabricated from an elastomeric material (e.g., molded rubber) in two pieces and joined together at a tapered, overlapping joint 334 located alongside and spaced from an outer periphery of the bottle assembly 200. The interface or joint 334 between the two parts of the housing 280 provides adequate electrical insulation and an environmental seal when the pieces are assembled. The pieces of the housing 280 are fitted over the respective components of the switch or interrupter assembly 322, such that one piece of the housing 280 contains the bottle assembly 200 and the external bottle contact 332, and the other piece contains the external current exchange 324 and the bottle actuator components. It is contemplated, however, that other housing configurations receiving other portions of the switch or interrupter assembly 322 may be employed in other embodiments, and it is further recognized that a single piece housing construction could be used to accommodate the entire switch or interrupter assembly 322.

The housing 280 is fabricated in an exemplary embodiment from an elastomeric material (e.g., rubber) that is resilient or stretchable. An inner diameter of each piece of the housing 280 is smaller than an outer diameter of the corresponding switch or interrupter components which they receive and as the housing pieces are extended over the respective switch or interrupter assembly components, the housing 280 stretches and generates an applied force against the outer surfaces of the switch or interrupter components. The applied force creates both a dielectric seal and a water seal, so that the components can be used below grade, in vaults, and in other areas subject to flooding. The force, however, is small compared to the strength of the bottle assembly 200, yet the housing 280 still provides adequate electrical insulation for the bottle assembly 200 and the rest of the switch interrupter components. Also, with the housing 280, any partial discharges that may occur in use have been found to be below allowable levels according to applicable electrical regulations. Still further, the rubber housing 280 and the bottle assembly 200 have been found to perform acceptably across an expected range of temperatures and thermal cycling conditions.

Each of the two pieces of the housing 280 includes an internal stress relief insert 336 or 338 for shielding purposes and to prevent discharges from occurring. An outer conductive shell 340 surrounds the housing 280, and like the housing 280 is fabricated in two mating pieces in an exemplary embodiment. For safety reasons, the external conductive shell 340 maintains the outside of the housing 280 at ground potential.

The vacuum bottle assembly 200 has a fixed external contact 332 attached to it at one end via threaded engagement, although other fastening techniques could be employed in alternative embodiments. The external current exchange 324 is placed over the internal current exchange 220 of the bottle at the opposite end of the bottle assembly 200. A throat connector 342 is attached to the external current exchange 324, and the throat connector 342 is mountable to a stationary plate 344 of the operating mechanism. Throat spacer elements 346 may be provided to facilitate the mechanical connection to the plate 344 of the operating mechanism. In use, the operating shaft 328 is attached to the coupler device 326, and the coupler 326 is, turn coupled to the movable rod 218 of the bottle assembly 200. The operating shaft 328 is fabricated from electrically insulating materials, and the guides 330 position the shaft 328 within the throat connector 342. The shaft 328 also includes a coupler 348 for connection to the operating mechanism.

An insulator support 350 is fastened to the external fixed contact 332 of the bottle assembly 200, and the insulator support 350 is received in an axial interface 351 at an end of the housing 280 opposite the throat connector 342. In an exemplary embodiment, the insulator support 350 is attached to the bottle contact 332 via threaded engagement, although other attachment and fastening schemes could be employed in further and/or alternative embodiments.

Figure 10:
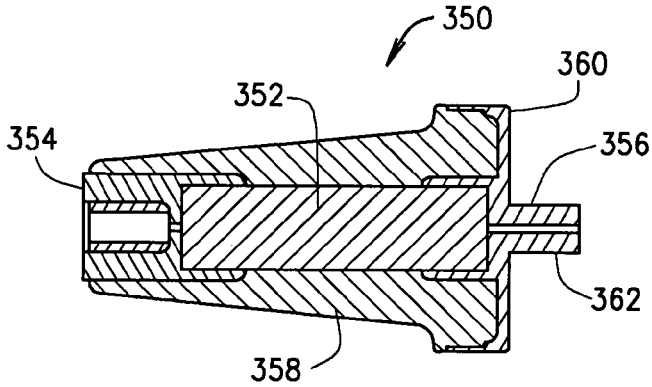
FIG. 10 is a cross sectional view of a portion of the assembly shown in FIG. 9.

Referring now to FIG. 10, in an exemplary embodiment the insulator support 350 includes a high strength insulating rod 352, end fittings 354 and 356 coupled to the rod 352, and a conical shaped body 358 surrounding the rod 352 and the end fittings 354 and 356. The end fitting 354, at the smaller end of the conical body 358, mates with the contact 332 (FIG. 9) of the bottle assembly 200 via, for example, threaded engagement. A molded conductive shell 360 surrounds the end fitting 356, and insulating rubber is molded over the rod/end fitting assembly and into cup portions of the shell 360 to form the conical shaped body 358 and a strong insulating structure of the support 350.

While one embodiment of the insulator support 350 has been described, it is recognized that other shapes, configurations, and materials may be employed in alternative embodiments to fabricate an insulator support according to other embodiments of the invention.

The support 350 is rigidly attached to the fixed contact 228 (FIG. 4) of the bottle assembly 200 through the contact 332 (FIG. 9). The axial interface 351 (FIG. 9) of the housing 280 mates with the tapered outer surface of the insulator body 358 to form a dielectric and hermetic seal on the end of the housing 280. The conductive shell 360 of the support 350 is mated with the housing outer shell 340 (FIG. 9) to assure the entire outside surface of the assembly 320 is held to ground potential.

In an exemplary embodiment, the end fitting 356 of the support 350 includes threads 362 to tie the support 350 to the operating mechanism, using for example, an external support structure 380 (FIG. 9) enclosing the housing 280.

In one embodiment, and referring back to FIG. 9, the external support structure 380 is an overwrap layer of a composite material applied directly to the outer surfaces of the insulating/shielding structure of the housing 280. Similar materials and methods of installation could be used to form the overwrap layer as the previously described internal overwrap layer 262 for the switch or interrupter module assembly 250. The rigid overwrap layer, provided external to the housing 280 as shown in FIG. 9, provides a direct mechanical connection to the operating mechanism to mechanically isolate the bottle assembly 200 from operating forces of the operating mechanism. If the composite wrap material includes, for example, fiberglass or Kevlar™ reinforcement strands or matting, the strength of the overwrap is sufficient to withstand operating mechanical stress as well as voltage stress and thermal stress as the rubber housing 280 and internal components expand and contract with temperature changes.

Figure 11:
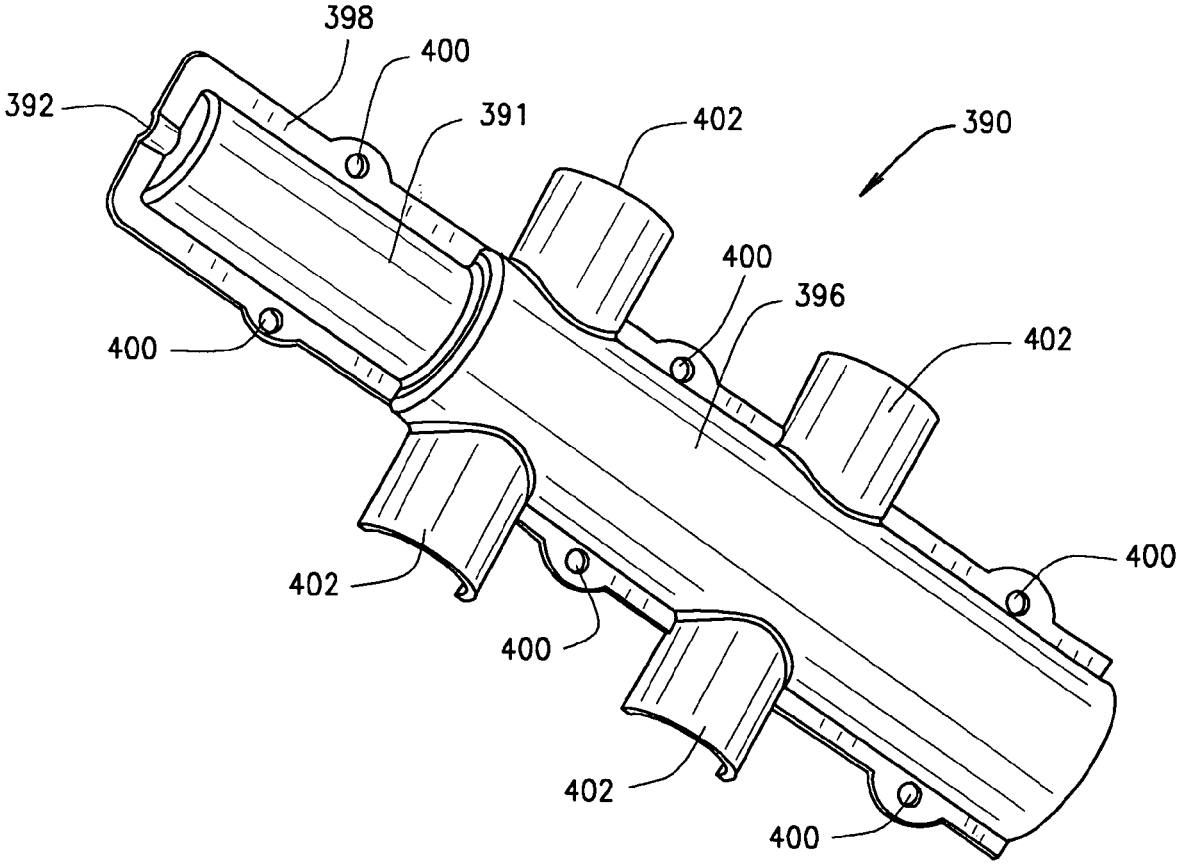
FIG. 11 is a perspective view of an alternative external support mounting support for the assembly shown in FIG. 9.

In an alternative embodiment, the external support structure 380 could be a separately fabricated support shell, such as the support shell 390 illustrated in FIG. 11. The shell 390 in an exemplary embodiment is fabricated according to a molding, stamping, or shaping process into a structural reinforcing member, such as that shown in FIG. 11. The shell 390 may be fabricated from metal or rigid polymers, for example, and is formed in two mirror image halves (only one of which is shown in FIG. 11) and fastened over the housing 280 (FIG. 9) of the switch or interrupter assembly 320.

In an exemplary embodiment, each of the halves of the shell 390 includes a mating end 392, a first semi-cylindrical portion 394 which extends over that portion of the housing 280 that includes the axial interface 351 (FIG. 9), and a second semi-cylindrical portion 396 that receives the portion of the housing 280 that includes the bottle assembly 200 and actuating components. A mounting rim or flange 398 extends around the periphery of the shell 390 and includes apertures 400 that receive known fasteners to secure the shells to one another when the housing 280 is received between the shells 390. Elbow interfaces 402 extend transversely to the semi-cylindrical portion 396 of the shell 390, and the interfaces 402 align and mate with corresponding elbow interfaces 404, 406 (FIG. 9) formed into the housing 280.

The mating end 392 of the shell 390 includes, for example, a fitting that engages the end fitting 356 (FIG. 10) of the insulator support 350 (FIG. 9). The opposite end of the shell 390 is connected to the operating mechanism to establish a direct mechanical connection to the operating mechanism to isolate the bottle assembly 200 mechanically from operating forces of the operating mechanism.

While an exemplary shape and configuration of the shell 390 is illustrated in FIGS. 9 and 11, it is recognized that other shapes and configurations of external reinforcing supports could be employed in other embodiments of the invention, provided that they establish a direct and secure mechanical connection between the operating mechanism structure and the support insulator 350. The bottle assembly 200 is therefore rigidly supported with respect to the operating mechanism, allowing proper force to be applied when opening and closing the bottle contacts, without causing operating forces to be directly applied to the ceramic portions or endcap portions of the bottle assembly 200.

While the insulator support 350 and the shell 390 provide external support to the assembly 320, as opposed to the internally supported assembly 298 described earlier, the benefits of the direct mechanical linkage and support between a stationary plate of the operating mechanism and the stationary end of the bottle are substantially the same whether the support is provided internally or externally.

Figure 12:
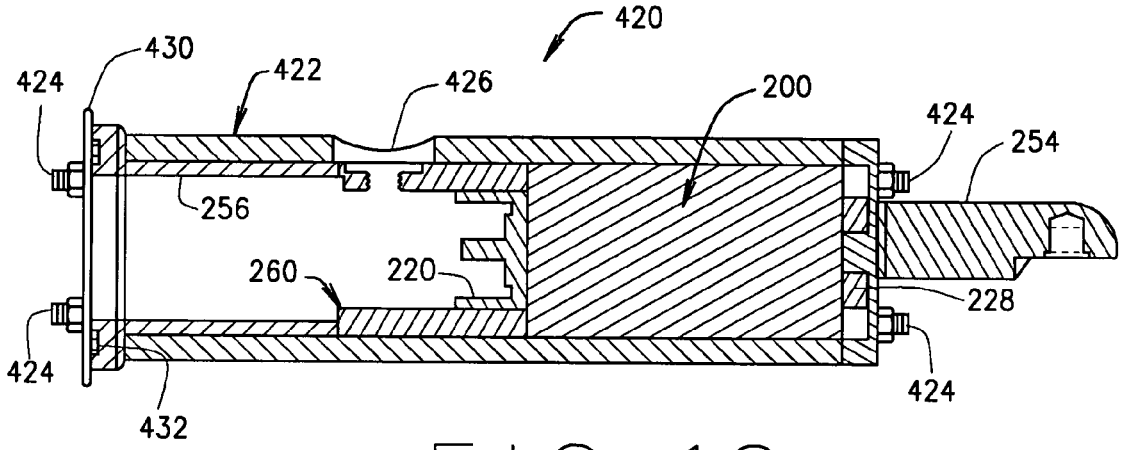
FIG. 12 is a cross sectional view of a switch or interrupter module according to another embodiment of the present invention.
Figure 13:
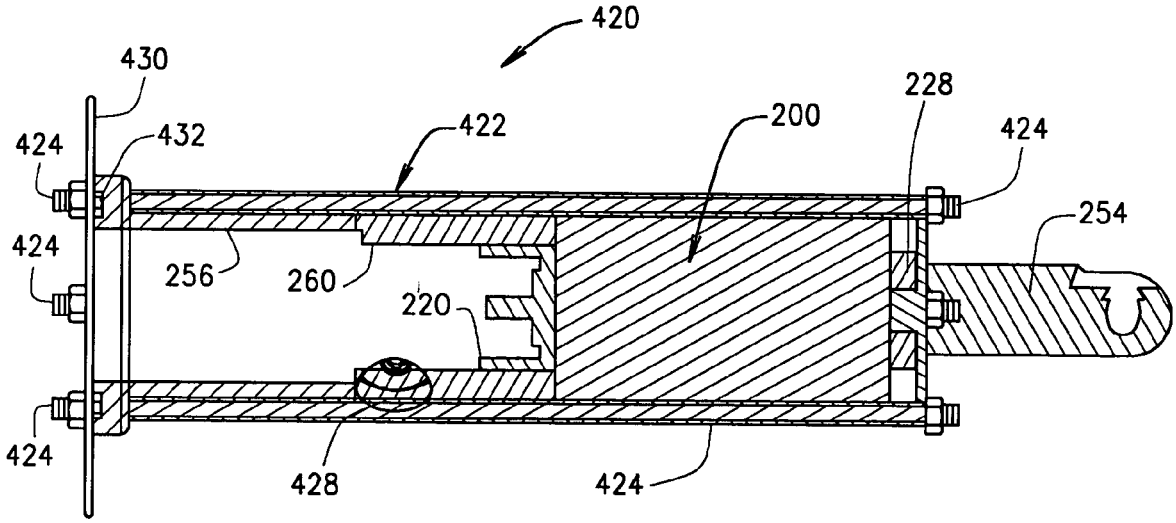
FIG. 13 is a view similar to FIG. 12 but rotated 45° about the axis of the module.

FIGS. 12 and 13 illustrate another exemplary embodiment of a vacuum switchgear module according to the present invention. The module assembly 420 is similar in some aspects to the module assembly 250 (FIGS. 5 and 6) and like features of the module assembly 420 and the assembly 250 are indicated in FIGS. 12 and 13 with like reference characters.

Like the module 250, the module 420 includes a stationary contact 254 that extends outwardly and is rigidly connected to one end of the bottle assembly 200, an internal current exchange 220 connected to the opposite end of the bottle assembly 200, an external current exchange 260, and an actuator throat connector 256 extends axially away from the current exchange 260. The throat connector 256 engages and connects to, for example, a mechanism attached to an actuator shaft (not shown in FIGS. 12 and 13) to open and close the conductive path through the bottle assembly 200 by moving the movable contact 210 relative to the fixed contact 208 (FIG. 4).

A mounting structure in the form of a reinforcing sleeve 422 receives and protects the bottle assembly 200, the external current exchange 260 and the throat connector 256. In an exemplary embodiment, the sleeve 422 is a fabricated from an elastomeric material, such as molded rubber, having insulating reinforcements or rods 424 therein. The elastomeric material of the sleeve 422 is resilient and stretchable, and the rods 424 are molded into the sleeve or pressed into holes molded into the sleeve 422. This sleeve 422 is placed over the vacuum bottle assembly 200 and external current exchange 260. A cross-hole 426 formed in the sleeve 422 to allow later connection of contacts (not shown in FIGS. 12 and 13) to the exchange 260. This hole 426 is aligned with the threaded cross-hole 428 in the external current exchange 260. In one embodiment, the cross hole 428 may be provided with a conductive rubber sleeve (not shown) molded into the inner diameter of the hole to prevent entrapped air from being stressed to the point it would go into a partial discharge. This sleeve would be in contact with an inner stress relief insert of a rubber housing (not shown in FIGS. 12 and 13) into which the module assembly 420 is inserted.

An inner diameter of the sleeve 422 is slightly smaller than an outer diameter of the bottle assembly 200 to create an interference fit and dielectric and mechanical seal therebetween. The external current interchange 260 is placed against the vacuum bottle assembly 200 and is held in place by the current exchange 220 that is mechanically and electrically connected to the bottle movable contact 210 (FIG. 4). The throat connector 256 is positioned against the external current interchange 260. Once positioned in this manner, the sleeve 422 is slid over these components and the sleeve 422 extends substantially an entire distance between the fixed external bottle contact 228 on one end of the bottle assembly 200 to an end of the throat connector 256 where it engages the operating mechanism. The sleeve 422 directly contacts and is in intimate contact with the outer surface of the bottle without the presence of intervening layers, materials or structure. The direct contact of the sleeve 422 with the bottle assembly 200 provides a sturdy structure when attached to the operating mechanism.

The contact 254 is attached to the stationary contact 228 of the bottle assembly 200 and the contact 254 has an outer diameter that matches the outer diameter of the sleeve 422 where the contact is located therein. The rods 424 are extended through holes in the contact 254 and the contact 254 is secured to the rods 424 with known fasteners (e.g., nuts and washers). A plate 430 (FIG. 13) is placed against the end of the throat connector 254, and in different embodiments, the plate may be part of the operating mechanism, an intermediate mounting plate used to attach the module 420 to the operating mechanism, or another stationary support. A gasket 432 (FIG. 12) may be placed between the throat connector 256 and the plate 430. Fasteners (e.g., nuts and washers) connect the rods 424 to the plate 430. It is recognized that a variety of fasteners and attachment features may be provided in other embodiments in lieu of nuts and washers to fix the rods to the contact 254 and to the plate 430.

Figure 14:
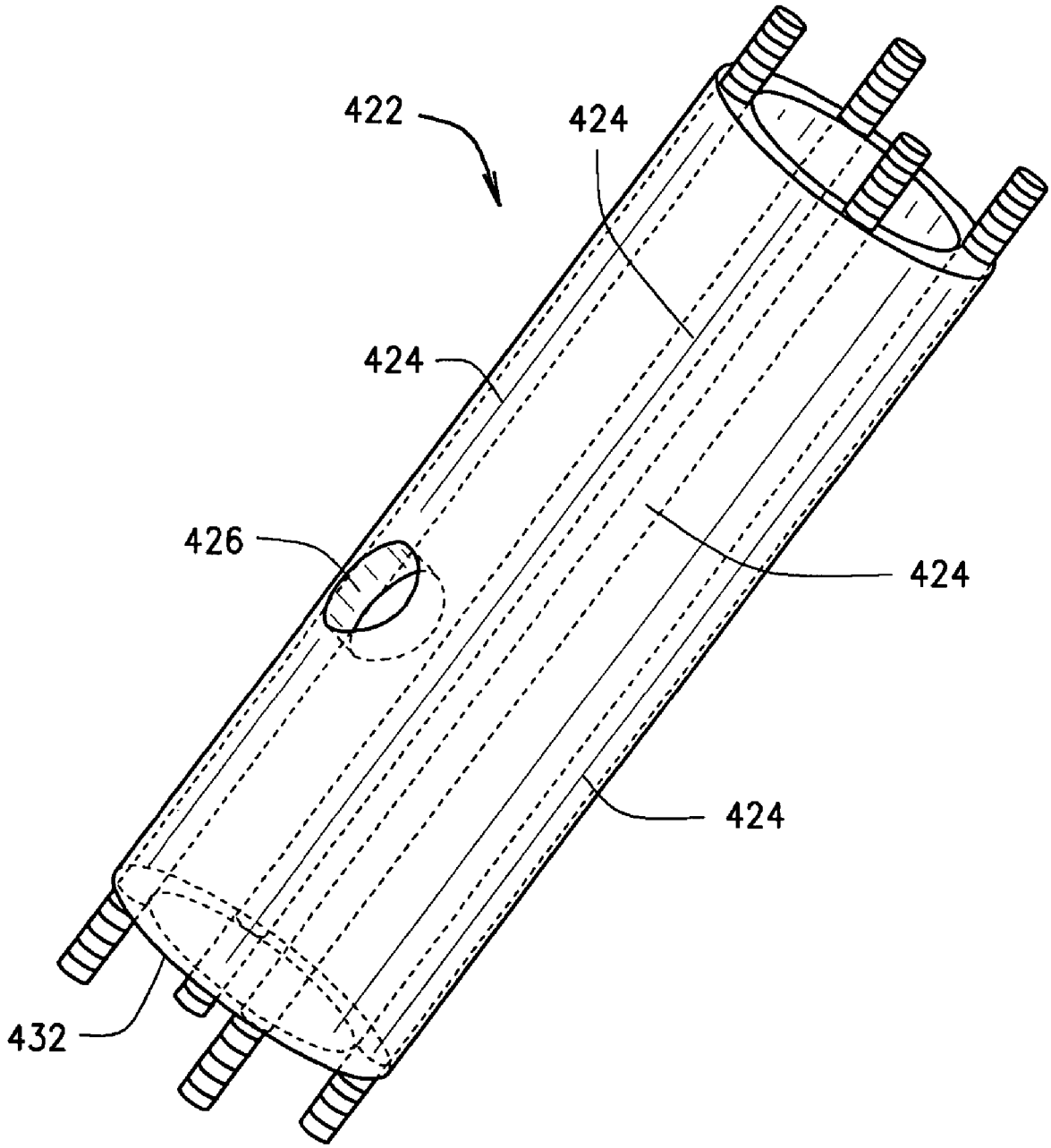
FIG. 14 is a perspective view of a reinforcing sleeve for the modules shown in FIGS. 12 and 13.

FIG. 14 illustrates the reinforcing sleeve 422 in perspective view, including four rigid rods 424 evenly spaced from one another within a cylindrical or tubular body 432 of elastomeric material, such as molded rubber, extending between the rods 424. The cross hole 426 is formed in the body 432 at a predetermined location to cross-hole 428 (FIG. 12) of the current exchange 260.

While four reinforcing rods 424 are illustrated in FIG. 14, it is understood that greater or fewer rods 424 could be provided in alternative embodiments of the sleeve 422, at uniform or non-uniform spacing on the body 432. Additionally, while substantially cylindrical rods 424 are illustrated in FIG. 14, other shapes and configurations of rods and reinforcing elements may be employed in other embodiments.

Figure 15:
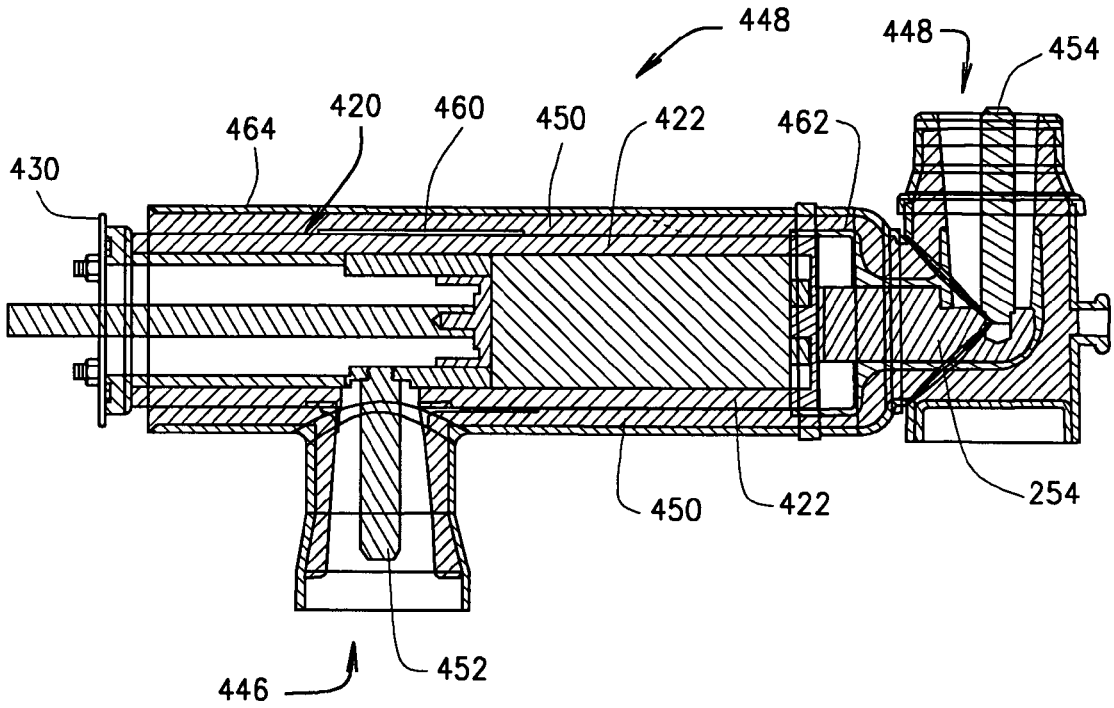
FIG. 15 is a cross sectional view of a switch or interrupter assembly including the module shown in FIGS. 12 and 13.
Figure 16:
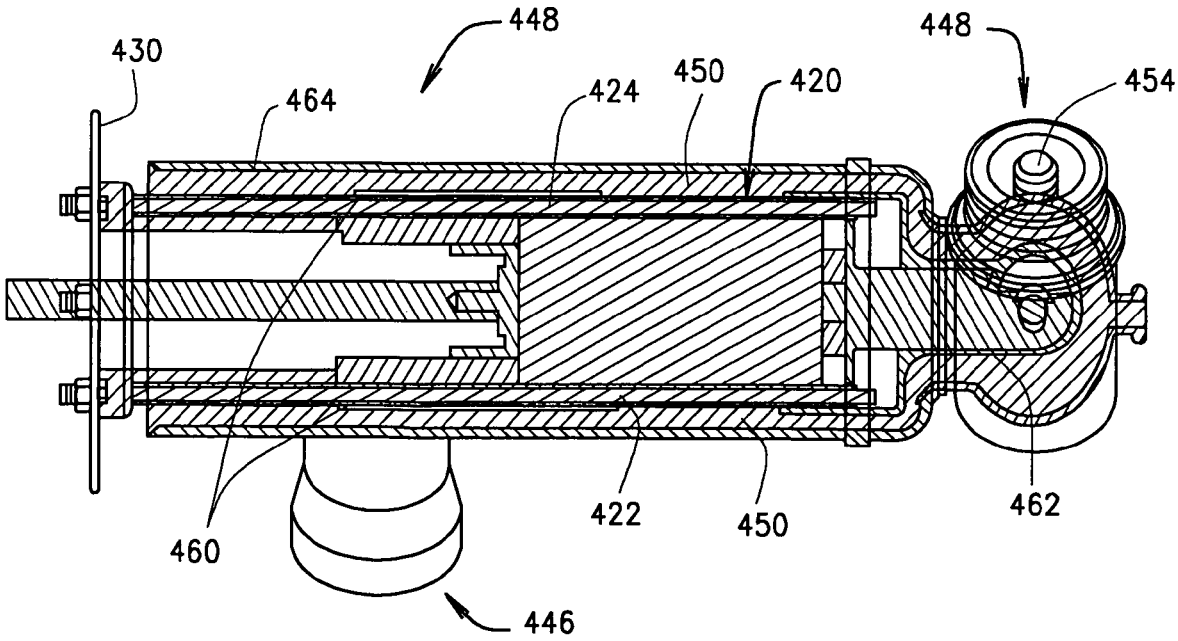
FIG. 16 is a cross sectional view similar to FIG. 15 but rotated 45° about the axis of the assembly.

FIGS. 15 and 16 illustrate vacuum switch or interrupter assemblies 448 including the module assembly 420 received in and surrounded by an insulating housing 450. Similar to the housing 280 described above, the housing 450 may be fabricated from rubber in one, two, or more parts or pieces, and the housing 450 is fitted over the sleeve 422 after the module 420 is assembled. Contacts 452 and 454 are received in elbow interfaces 446 and 448 formed into the housing 450. The contact 452 connects the external current exchange 260, and the contact 454 connects to the contact 254 on the stationary end of the bottle. Stress relief inserts 460 and 462 are provided in the housing 450 to prevent discharges, and a conductive shell 464 is provided on the outer surface of the housing 450 to maintain the outer surface at ground potential.

The rigid rods 454 in the sleeve 422 provide a direct mechanical connection between the operating mechanism and the stationary contact structure of the bottle assembly 200 to isolate the bottle assembly 200 from operating forces of the operating mechanism.

Like the foregoing embodiments, a direct mechanical linkage is provided in the assembly 448 that supports the stationary end of the bottle assembly 200 in a predetermined fixed relationship to the operating mechanism. The direct and continuous mechanical connection of the sleeve 422 bears axial loads placed on the assembly and mechanical isolates the bottle assembly 200 from operating loads due to movement of the actuator shaft. Likewise, the sleeve 422 and bottle assembly 200 capably withstand thermal stress and thermal cycling under various operating conditions.

Figure 17:
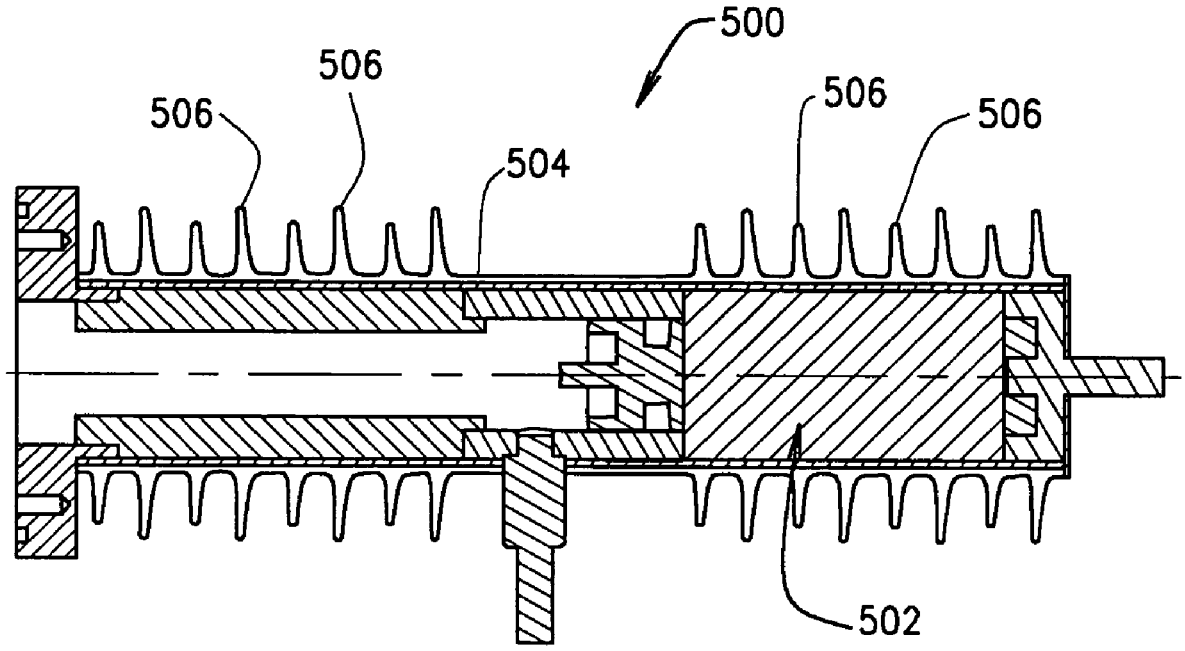
FIG. 17 is a cross sectional view of another embodiment of a switch or interrupter assembly according to the present invention.

FIG. 17 is a cross sectional view of another switch or interrupter module 500 according to another embodiment of the present invention. The bottle assembly 500 includes a bottle assembly 502 and an insulating housing 504. In different embodiments, the bottle assembly 500 may be advantageously fabricated, assembled, and rigidly supported within the housing 504 in a manner similar to any of the embodiments described above. Unlike the embodiments previously described, the housing 504 is configured or adapted for overhead installation. Thus, in one example, and as shown in FIG. 17, the housing 504 may include a plurality of weather skirts 506 formed in a known manner. Additionally, other insulation features familiar to those in the art may be provided in the module 500 as appropriate for particular installations and to withstand operating conditions of an overhead installation. It is believed that such modifications to the module could be made by those in the art without further explanation.

Multiple embodiments of vacuum switch or interrupter assemblies have now been described which provide a mounting structure and electrical insulation for vacuum switchgear assemblies that more capably withstand thermal stress and cycling in use, improve reliability of the switchgear as the contacts are opened and closed, simplify manufacture and assembly of the devices and associated switchgear, and provide cost advantages in relation to known switch or interrupter devices and associated switchgear. These and other advantages are achieved without conventional epoxy molding and casting processes and associated materials of indefinite shape and volume used to encapsulate and reinforce the bottle assembly of the switch or interrupter element that are used in conventional solid insulated switchgear of this type. Furthermore, the above-described embodiments of the invention accordingly avoid manufacturing and performance issues to which conventionally encapsulated switchgear may be susceptible. Additionally, the above-described embodiments achieve the aforementioned advantages without separate elastomeric buffer and filler materials that are common to some known switches and interrupters of this type. The embodiments may be used in various types of switchgear and equipment as desired, and may be modified appropriately for use in subsurface, overhead or above ground installations, or even submerged or underwater installations in a power distribution system.

One embodiment of a switchgear element assembly is disclosed herein that comprises an insulator defining a bore and having a fixed contact therein, a movable contact mounted to the insulator and selectively positionable relative to the fixed contact, and an elastomeric insulating housing enclosing the insulator. A rigid support structure mechanically isolates the insulator from axial loads, and the support structure includes first and second ends. The support structure supports the fixed contact at the first end and extends at the second end to an operating mechanism for positioning the movable contact relative to the fixed contact, and at least one of the elastomeric insulating housing and the support structure directly contacts an outer surface of the insulator without requiring casting of the insulator within an encapsulant material.

Optionally the support structure may extend internally to the insulating housing and directly contact the outer surface of the insulator. Alternatively, the support structure extending externally to the insulating housing and the housing directly contacting the outer surface of the insulator. The support structure may comprise an overwrap layer of composite material may directly contact an outer surface of the insulator, or may directly contact an outer surface of the insulating housing. The overwrap layer of composite material may have a thermal coefficient of expansion approximately equal to a thermal coefficient of expansion of the insulator, and may have a matting or continuous strands of insulating material embedded in a polymeric compound that becomes rigid when the composite material is cured. Alternatively, the support structure may include an elastomeric sleeve directly contacting an outer surface of the insulator with the sleeve including at least one reinforcing rod, or an insulating support rigidly connected to the fixed contact of the insulator with the support structure extending between and rigidly connected to the insulating support and to the operating mechanism.

Another embodiment of a switchgear element for electrical switchgear is disclosed herein. The switchgear comprises a substantially nonconductive elastomeric housing, and a vacuum bottle assembly within the housing. The bottle assembly has a fixed contact therein and a movable contact mounted thereto, and the movable contact is positionable relative to the fixed contact. A connector is configured for attachment to a stationary support, and the connector is positioned within the insulative housing at an end thereof opposite the bottle assembly. A rigid support structure extends between the stationary support on one end of the housing and the bottle assembly on an opposite end of the housing, and the support structure applied to the vacuum bottle assembly by means other than casting. The support structure is configured to mechanically isolate the vacuum bottle assembly from mechanical loads when connected to the switchgear, and at least one of the support structure and the elastomeric housing directly contacts an outer surface of the bottle assembly.

Optionally, the support structure may extend internally to the housing and be in direct contact with an outer surface of the bottle assembly. Alternatively, the support structure extends externally to the housing, and the housing extends between the bottle assembly and the support structure with the housing directly contacting an outer surface of the bottle assembly. The support structure may comprise an overwrap layer of composite material directly contacting an outer surface of the bottle assembly, an elastomeric sleeve directly contacting an outer surface of the bottle assembly with the sleeve including at least one reinforcing rod, or an insulating support rigidly connected to the fixed contact of the bottle assembly with the reinforcing structure extending between and rigidly connected to the insulating support and to the operating mechanism. When the support structure is an overwrap layer of composite material directly contacting an outer surface of the housing, the overwrap layer of composite material may have a thermal coefficient of expansion approximately equal to a thermal coefficient of expansion of the insulator. A conductive shell to be maintained at ground potential may be optionally provided, and the conductive shell may be positioned between the bottle assembly and the rigid support, or may surround an outer surface of the insulating housing. The elastomeric housing may be adapted for overhead installation.

An embodiment of vacuum switchgear element for electrical switchgear is disclosed herein, comprising a substantially nonconductive elastomeric housing, and a vacuum bottle assembly within the housing. The bottle assembly has a fixed contact therein and a movable contact mounted thereto, with the movable contact positionable relative to the fixed contact between open and closed positions. A connector is configured for attachment to a stationary support, and the connector is positioned within the housing at an end thereof opposite the bottle assembly. A rigid support structure extends between the stationary support on one end of the housing and the bottle assembly on an opposite end of the housing, and the support structure comprises a composite overwrap material coupled to the vacuum bottle assembly and configured to isolate the vacuum bottle assembly from mechanical loads when connected to the switchgear. At least one of the support structure and the elastomeric housing directly contact an outer surface of the bottle assembly.

Optionally, the composite overwrap material extends internally to the housing and is in direct contact with an outer surface of the bottle assembly, or alternatively may extend externally to the housing with the housing extends between the bottle assembly and the composite overwrap and the housing directly contacting an outer surface of the bottle assembly. The elastomeric housing may be adapted for overhead installation.

An embodiment of vacuum switchgear element for electrical switchgear is disclosed herein that comprises a substantially nonconductive elastomeric housing and a vacuum bottle assembly within the housing. The bottle assembly has a fixed contact therein and a movable contact mounted thereto, and the movable contact is positionable relative to the fixed contact between open and closed positions. A connector is configured for attachment to a stationary support, and the connector is positioned within the housing at an end thereof opposite the bottle assembly. A rigid support structure extends between the stationary support on one end of the housing and the bottle assembly on an opposite end of the housing. The support structure comprises an insulating support fastened to the fixed contact of the bottle assembly, and an external support structure extending between and rigidly connected to the insulating support and to the operating mechanism. The insulating support and the external support structure mechanically isolate the vacuum bottle assembly from mechanical loads when connected to the switchgear, and at least one of the support structure and the elastomeric housing directly contacts an outer surface of the bottle assembly.

Optionally, the external support structure comprises an overwrap layer of composite material applied directly to an outer surface of the housing. Alternatively, he external support structure comprises a separately fabricated support shell. The elastomeric housing may be adapted for overhead installation.

An embodiment of a vacuum switchgear element for electrical switchgear is also disclosed herein. The switchgear element comprises a substantially nonconductive elastomeric housing, and a vacuum bottle assembly within the housing. The bottle assembly has a fixed contact therein and a movable contact mounted thereto, and the movable contact positionable relative to the fixed contact between open and closed positions. A connector is configured for attachment to a stationary support, and the connector is positioned within the insulative housing at an end thereof opposite the bottle assembly. A rigid support structure extends between the stationary support on one end of the housing and the bottle assembly on an opposite end of the housing. The support structure comprises an elastomeric sleeve directly contacting an outer surface of the bottle assembly, with the sleeve including at least one reinforcing rod configured to isolate the vacuum bottle assembly from mechanical loads when connected to the switchgear.

An embodiment of an electric switchgear system is also disclosed herein, and the system comprises a bus bar system, a plurality of active switchgear elements coupled to the bus bar system, a plurality of power cables each respectively connected to the respective active switchgear elements, and an operating mechanism for opening and closing the active switchgear elements. At least one of the plurality of active switchgear elements comprises an insulating housing having a solid body and defining a bore therethrough, and a bottle assembly received in the bore and enclosed in the housing and comprising a vacuum insulator, a movable contact actuated by the operating mechanism, a fixed contact, and an actuator connector. A rigid support structure axially supports and mechanically isolates the vacuum insulator from the operating mechanism without encapsulating the vacuum insulator in a material of indefinite shape and volume. The rigid support structure is engaged to the fixed contact at a first end of the insulating housing, supports the actuator connector at a second end of the insulating housing opposite the first end, and rigidly connects the first and second ends therebetween.

Optionally, the support structure extends internally to the insulating housing and is in direct contact with an outer surface of the insulator, or may extend externally to the insulated housing with the insulating housing extending between the insulator and the support structure and the insulating housing directly contacting an outer surface of the insulator. The support structure may comprise an overwrap layer of composite material directly contacting an outer surface of the insulator, an elastomeric sleeve directly contacting an outer surface of the bottle assembly with the sleeve including at least one reinforcing rod. When the support structure comprises an overwrap layer of composite material, the material may have a thermal coefficient of expansion approximately equal to a thermal coefficient of expansion of the bottle assembly. The bus bar system ioptionally s a modular bus bar system. At least one of the plurality of switchgear elements may be adapted for overhead installation.

An embodiment of a switchgear element assembly is disclosed herein that comprises insulator means for enclosing a fixed contact and for defining a vacuum chamber, movable contact means for completing and interrupting a conductive path through the fixed contact, housing means for enclosing the insulator means, and means for mechanically isolating the insulator means from axial loads and supporting the fixed contact relative to an operating mechanism for positioning the movable contact means relative to the fixed contact. The means for mechanically isolating the insulator means substantially encloses the insulator means and supports the insulator means in a rigid manner without depending upon a reinforcing casting encapsulant, and the assembly is devoid of materials of indefinite shape and volume.

Optionally, the means for mechanically isolating supports the insulator means internally to the housing means and directly contacts an outer surface of the insulator means. The means for mechanically isolating may support the insulator means externally to the insulating means, with the housing means directly contacts the outer surface of the insulating means. The means for mechanically isolating may support the insulator means with an overwrap layer of composite material directly contacting an outer surface of the insulating means, or the means for mechanically isolating may support the insulator means with an elastomeric sleeve directly contacting an outer surface of the insulator means with the sleeve including at least one reinforcing rod. Alternatively, the means for mechanically isolating may comprise an insulating support rigidly connected to the fixed contact of the insulating means, with the reinforcing structure extending between and rigidly connected to the insulating support and to the operating mechanism. The means for mechanically isolating may support the insulator means with a material having a coefficient of thermal expansion approximately equal to a coefficient of thermal expansion of the insulator, and may comprise an overwrap layer of composite material having a matting of continuous strands of insulating material embedded in a polymeric compound that becomes rigid when the composite material is cured.

A method of assembling switchgear is disclosed herein, and the method comprises providing at least one active switchgear element including a substantially nonconductive elastomeric housing and a vacuum bottle assembly within the housing. The bottle assembly has a fixed contact therein and a movable contact mounted thereto, and the switchgear element further includes a connector configured for attachment to an operating mechanism, with the connector positioned within the housing at an end thereof opposite the bottle assembly. The connector includes a rigid support structure extending between the stationary support on one end of the housing and the bottle assembly on an opposite end of the housing, and the support structure is configured to isolate the vacuum bottle assembly from mechanical loads when connected to the switchgear. At least one of the support structure and the elastomeric housing directly contacts an outer surface of the bottle assembly, wherein the vacuum bottle assembly lacks a reinforcement casting. The method further includes mounting the active switchgear element relative to the stationary plate with the rigid non-epoxy encapsulant support structure, and connecting an operating shaft of an operating mechanism to the connector.

The method may optionally further comprise connecting the active switch element to a bus bar system. enclosing the active switchgear element, and connecting a power cable to the active switchgear element.

While the invention has been described in terms of various specific embodiments, those skilled in the art will recognize that the invention can be practiced with modification within the spirit and scope of the claims.

What is claimed is:

1. A switchgear element assembly, comprising:

an insulator defining a bore and having a fixed contact therein;

a movable contact mounted to the insulator and selectively positionable relative to the fixed contact;

an elastomeric insulating housing enclosing the insulator; and a rigid support structure mechanically isolating the insulator from axial loads, the rigid support structure comprising first and second ends, the rigid support structure supporting the fixed contact at the first end and extending at the second end to an operating mechanism for positioning the movable contact relative to the fixed contact, the rigid support structure comprising an overwrap layer of composite material formed from one of a matting of insulating material and a plurality of continuous strands of insulating material, the one of the matting of insulating material and the plurality of continuous strands of insulating material being embedded in a polymeric compound configured to become rigid when the composite material is cured, at least one of the elastomeric insulating housing and the rigid support structure directly contacting an outer surface of the insulator without an encapsulant material being cast around the insulator.

2. The switchgear element assembly according to claim 1, wherein the rigid support structure extends internally within the insulating housing and directly contacts the outer surface of the insulator.

3. The switchgear element assembly according to claim 1, wherein the rigid support structure extends externally to the insulating housing, and wherein the housing directly contacts the outer surface of the insulator.

4. The switchgear element assembly according to claim 1, wherein the overwrap layer of composite material directly contacts the outer surface of the insulator.

5. The switchgear element assembly according to claim 1, wherein the overwrap layer of composite material directly contacts an outer surface of the elastomeric insulating housing.

6. The switchgear element assembly according to claim 1, wherein the overwrap layer of composite material has a thermal coefficient of expansion approximately equal to a thermal coefficient of expansion of the insulator.

7. A switchgear element for electrical switchgear, comprising:

a substantially nonconductive elastomeric housing;

a vacuum bottle assembly disposed within the housing, the vacuum bottle assembly having a fixed contact therein and a movable contact mounted thereto, the movable contact being positionable relative to the fixed contact;

a connector configured to be attached to a stationary support, the connector being positioned within the elastomeric housing, at an end thereof opposite the vacuum bottle assembly; and a rigid support structure extending between the stationary support and the vacuum bottle assembly, the rigid support structure being configured to mechanically isolate the vacuum bottle assembly from mechanical loads when connected to a switchgear, the rigid support structure comprising an overwrap layer of composite material disposed within the elastomeric housing, directly contacting an outer surface of the vacuum bottle assembly, wherein the composite material is formed from one of a matting of insulating material and a plurality of continuous strands of insulating material, the one of the matting of insulating material and the plurality of continuous strands of insulating material being embedded in a polymeric compound configured to become rigid when the composite material is cured.

8. The switchgear element according to claim 7, wherein the rigid support structure comprises an elastomeric sleeve directly contacting the outer surface of the vacuum bottle assembly, the elastomeric sleeve comprising at least one reinforcing rod.

9. The switchgear element according to claim 7, wherein the rigid support structure comprises an insulating support rigidly connected to the fixed contact of the vacuum bottle assembly, and an external support structure extending between and rigidly connected to the insulating support and to an operating mechanism configured to position the movable contact relative to the fixed contact.

10. The switchgear element according to claim 7, wherein the overwrap layer of composite material has a thermal coefficient of expansion approximately equal to a thermal coefficient of expansion of the vacuum bottle assembly.

11. The switchgear element according to claim 7, further comprising a conductive shell configured to be maintained at ground potential, the conductive shell surrounding an outer surface of the elastomeric housing.

12. A vacuum switchgear element for electrical switchgear, comprising:

a substantially nonconductive elastomeric housing;

a vacuum bottle assembly disposed within the elastomeric housing, the vacuum bottle assembly having a fixed contact therein and a movable contact mounted thereto, the movable contact being positionable relative to the fixed contact between open and closed positions;

a connector configured to be attached to a stationary support, the connector being positioned within the elastomeric housing, at an end thereof opposite the vacuum bottle assembly; and a rigid support structure extending between the stationary support and the vacuum bottle assembly, the rigid support structure comprising an overwrap layer of composite material coupled to the vacuum bottle assembly and configured to isolate the vacuum bottle assembly from mechanical loads when connected to a switchgear, at least one of the rigid support structure and the elastomeric housing directly contacting an outer surface of the vacuum bottle assembly, wherein the composite material is formed from one of a matting of insulating material and a plurality of continuous strands of insulating material, the one of the matting of insulating material and the plurality of continuous strands of insulating material being embedded in a polymeric compound configured to become rigid when the composite material is cured.

13. The vacuum switchgear element according to claim 12, wherein the overwrap layer is disposed within the elastomeric housing and is in direct contact with the outer surface of the vacuum bottle assembly.

14. The vacuum switchgear element according to claim 12, wherein the overwrap layer extends externally to the housing, and wherein the elastomeric housing extends between the vacuum bottle assembly and the overwrap layer, the elastomeric housing directly contacting the outer surface of the vacuum bottle assembly.

15. A vacuum switchgear element for electrical switchgear, comprising:

a substantially nonconductive elastomeric housing;

a vacuum bottle assembly disposed within the elastomeric housing, the vacuum bottle assembly having a fixed contact therein and a movable contact mounted thereto, the movable contact being positionable relative to the fixed contact by an operating mechanism;

a connector configured to be attached to a stationary support, the connector being positioned within the elastomeric housing, at an end thereof opposite the vacuum bottle assembly; and a rigid support structure extending between the stationary support and the vacuum bottle assembly, the rigid support structure comprising an insulating support fastened to the fixed contact of the vacuum bottle assembly, inside the elastomeric housing, and an external support structure disposed outside the elastomeric housing, extending between and rigidly connected to the insulating support and to the operating mechanism, the external support structure comprising an overwrap layer of composite material applied directly to an outer surface of the elastomeric housing, the composite material being formed from one of a matting of insulating material and a plurality of continuous strands of insulating material, the one of the matting of insulating material and the plurality of continuous strands of insulating material being embedded in a polymeric compound configured to become rigid when the composite material is cured, wherein the insulating support and the external support structure mechanically isolate the vacuum bottle assembly from mechanical loads when connected to a switchgear, at least one of the rigid support structure and the elastomeric housing directly contacting an outer surface of the vacuum bottle assembly.

16. The vacuum switchgear element according to claim 15, wherein the external support structure comprises a separately fabricated support shell.

17. A vacuum switchgear element for electrical switchgear, comprising:

a substantially nonconductive elastomeric housing;

a vacuum bottle assembly disposed within the housing, the vacuum bottle assembly having a fixed contact therein and a movable contact mounted thereto, the movable contact being positionable relative to the fixed contact between open and closed positions;

a connector configured to be attached to a stationary support, the connector being positioned within the elastomeric housing, at an end thereof opposite the vacuum bottle assembly; and a rigid support structure extending between the stationary support and the vacuum bottle assembly, the rigid support structure comprising an elastomeric sleeve directly contacting an outer surface of the vacuum bottle assembly, the elastomeric sleeve comprising at least one reinforcing rod configured to isolate the vacuum bottle assembly from mechanical loads when connected to a switchgear.

18. The switchgear element according to claim 7, wherein the elastomeric housing is adapted for overhead installation.

19. The vacuum switchgear element according to claim 12, wherein the elastomeric housing is adapted for overhead installation.

20. The vacuum switchgear element according to claim 15, wherein the elastomeric housing is adapted for overhead installation.

21. A switchgear element assembly, comprising:

an insulator defining a bore and having a fixed contact therein;

a movable contact mounted to the insulator and selectively positionable relative to the fixed contact;

an elastomeric insulating housing enclosing the insulator; and a rigid support structure mechanically isolating the insulator from axial loads, the rigid support structure comprising first and second ends, the rigid support structure supporting the fixed contact at the first end and extending at the second end to an operating mechanism for positioning the movable contact relative to the fixed contact, the rigid support structure comprising an overwrap layer of composite material formed from one of a matting of insulating material and a plurality of continuous strands of insulating material, the one of the matting of insulating material and the plurality of continuous strands of insulating material being embedded in a polymeric compound configured to become rigid when the composite material is cured.

22. The switchgear element assembly according to claim 21, wherein the overwrap layer of composite material is disposed within the elastomeric insulating housing.

23. The switchgear element assembly according to claim 21, wherein the overwrap layer of composite material directly contacts an outer surface of the insulator.

24. The switchgear element assembly according to claim 21, wherein the composite material has a thermal coefficient of expansion approximately equal to a thermal coefficient of expansion of the insulator.

25. The switchgear element assembly according to claim 21, wherein the elastomeric insulating housing is adapted for overhead installation.

26. The switchgear element assembly according to claim 1, wherein the elastomeric insulating housing is adapted for overhead installation.

27. A switchgear element assembly, comprising:

an insulator defining a bore and having a fixed contact therein;

a movable contact mounted to the insulator and selectively positionable relative to the fixed contact;

an elastomeric insulating housing enclosing the insulator; and a rigid support structure mechanically isolating the insulator from axial loads, the rigid support structure comprising first and second ends, the rigid support structure supporting the fixed contact at the first end and extending at the second end to an operating mechanism for positioning the movable contact relative to the fixed contact, the rigid support structure comprising an elastomeric sleeve that directly contacts the outer surface of the insulator, the elastomeric sleeve comprising at least one reinforcing rod, at least one of the elastomeric insulating housing and the rigid support structure directly contacting an outer surface of the insulator without an encapsulant material being cast around the insulator.

* * * * *